US011831113B2

(12) United States Patent
Byrne et al.

(10) Patent No.: US 11,831,113 B2
(45) **Date of Patent: *Nov. 28, 2023**

(54) MODULAR ELECTRICAL SYSTEM

(71) Applicant: Norman R. Byrne, Ada, MI (US)

(72) Inventors: Norman R. Byrne, Ada, MI (US); Timothy J. Warwick, Sparta, MI (US); Gerald N. Vander Till, Grandville, MI (US)

(73) Assignee: Norman R. Byrne, Ada, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/717,781

(22) Filed: Apr. 11, 2022

(65) Prior Publication Data

US 2022/0239045 A1 Jul. 28, 2022

Related U.S. Application Data

(63) Continuation of application No. 16/884,690, filed on May 27, 2020, now Pat. No. 11,303,079.

(60) Provisional application No. 62/853,461, filed on May 28, 2019.

(51) Int. Cl.
*H01R 31/02* (2006.01)
*H01R 13/46* (2006.01)

(52) U.S. Cl.
CPC ..... *H01R 31/02* (2013.01); *H01R 13/46* (2013.01)

(58) Field of Classification Search
CPC ..... H01R 31/02; H01R 13/46
USPC ..... 439/502
See application file for complete search history.

(56) References Cited

U.S. PATENT DOCUMENTS

| | | | |
|---|---|---|---|
| 2,157,527 | A | 5/1939 | Clarke et al. |
| 2,952,829 | A | 9/1960 | Grohsgal |
| 2,963,676 | A | 12/1960 | Sneesby et al. |
| 2,979,576 | A | 4/1961 | Huber |
| 3,049,688 | A | 8/1962 | Sinopoli |
| 3,187,290 | A | 6/1965 | Winders |
| 3,208,121 | A | 9/1965 | Price |
| 3,297,886 | A | 1/1967 | Danner |
| 3,585,569 | A | 6/1971 | Moran |
| 3,598,900 | A | 8/1971 | Drake |

(Continued)

FOREIGN PATENT DOCUMENTS

GB 2229869 A 10/1990

*Primary Examiner* — Harshad C Patel
(74) *Attorney, Agent, or Firm* — Gardner, Linn, Burkhart & Ondersma LLP

(57) ABSTRACT

A modular electrical system with electrical and/or data outlets provides an unobtrusive power and/or data source that can be routed along a floor, a table or other work surface in a work area. The modular system includes a plurality of electrical wiring modules, a plurality of junction modules each having multiple outputs, and a plurality of electrical power or data units connected to the junction modules and to surfaces in the work area. Optionally, a modular floor runner system is assembled together from rigid floor runner modules interposed with junction modules, with one or more flexible branch extensions selectively coupled to any desired junction module. The floor runner modules and junction modules include housings that protect electrical wiring held internally, while being minimally intrusive for use in walking areas. Optionally, a table mounted modular electrical system is connectable to a floor runner system, and vice versa.

20 Claims, 18 Drawing Sheets

(56) References Cited

U.S. PATENT DOCUMENTS 3,715,627 A 2/1973 D'Ausilio
3,773,987 A 11/1973 Davis et al.
3,984,622 A 10/1976 Ross
4,099,824 A 7/1978 Schoppelrey
4,201,278 A 5/1980 Balde
4,399,371 A 8/1983 Ziff et al.
4,434,377 A 2/1984 Shima et al.
4,499,341 A 2/1985 Boyd
4,553,798 A 11/1985 Murphy
4,688,869 A 8/1987 Kelly
4,780,094 A 10/1988 Batty et al.
4,864,081 A 9/1989 Bates
4,875,871 A 10/1989 Booty, Sr. et al.
5,044,971 A 9/1991 Hollingsworth
5,158,472 A 10/1992 Juhlin
5,174,647 A 12/1992 Kelly
5,203,711 A 4/1993 Bogiel
5,234,360 A 8/1993 Kramer, Jr.
5,236,374 A 8/1993 Leonard et al.
5,238,424 A 8/1993 Vindum
5,243,129 A 9/1993 Bates et al.
5,275,574 A 1/1994 Schlothauer et al.
5,283,392 A 2/1994 Ooshima et al.
5,306,165 A 4/1994 Nadeau
5,414,212 A 5/1995 Clouet et al.
5,518,214 A 5/1996 Spencer
5,547,399 A 8/1996 Naghi et al.
5,575,668 A 11/1996 Timmerman
5,582,522 A 12/1996 Johnson
5,606,150 A 2/1997 Radliff et al.
5,607,317 A 3/1997 King et al.
5,616,968 A 4/1997 Fujii et al.
5,676,563 A 10/1997 Kondo et al.
5,804,768 A 9/1998 Sexton
RE36,030 E 1/1999 Nadeau
5,899,774 A 5/1999 Sexton
5,902,148 A 5/1999 O'Rourke
5,957,714 A 9/1999 Johnson et al.
6,028,267 A 2/2000 Byrne
6,045,399 A 4/2000 Yu
6,107,577 A 8/2000 Sexton
6,133,845 A 10/2000 Toms et al.
6,179,381 B1 1/2001 Gevaert
6,207,894 B1 3/2001 Reiker
6,248,663 B1 6/2001 Bixler et al.
6,257,923 B1 7/2001 Stone et al.
6,259,027 B1 7/2001 Watanabe
6,276,502 B1 8/2001 Leyba et al.
6,281,434 B1 8/2001 Gretz
6,281,439 B1 8/2001 Reiker
6,290,518 B1 9/2001 Byrne
6,350,135 B1 2/2002 Acklin et al.
6,362,987 B1 3/2002 Yurek et al.
6,367,211 B1 4/2002 Weener et al.
6,388,190 B1 5/2002 Laukhuf et al.
6,464,516 B2 10/2002 Baldock
6,486,407 B1 11/2002 Hawker et al.
6,492,594 B1 12/2002 Magyar et al.
6,540,536 B1 4/2003 Young
6,540,549 B2 4/2003 Rupert
6,566,598 B1 5/2003 Strong
6,573,617 B2 6/2003 Jones et al.
6,598,366 B2 7/2003 Hsieh et al.
6,746,273 B1 6/2004 Liu et al.
6,767,255 B1 7/2004 Croswell
6,797,885 B2 8/2004 Magyar et al.
6,786,765 B2 9/2004 Bauermeister et al.
6,805,579 B2 10/2004 Marchand et al.
6,827,592 B2 12/2004 McCoy et al.
6,844,493 B2 1/2005 Strong
6,871,812 B1 3/2005 Chang
7,057,108 B1 6/2006 Sodemann et al.
7,066,616 B2 6/2006 Howell
7,094,077 B1 8/2006 Chen
7,114,972 B1 10/2006 Riner
7,196,273 B2 3/2007 Tanaka et al.
7,201,589 B2 4/2007 Jong
7,205,487 B1 4/2007 Plattner
7,210,960 B2 5/2007 Mak
7,220,128 B1 5/2007 Hicks
7,229,302 B1 6/2007 Lai
7,282,645 B2 10/2007 Locke
7,285,021 B2 10/2007 Bell et al.
7,329,131 B1 2/2008 Chen
7,438,566 B2 10/2008 Chen
7,467,967 B2 12/2008 Kuo
7,481,658 B2 1/2009 Jong
7,494,244 B1 2/2009 Van Diep et al.
7,511,226 B2 3/2009 Fahey
7,524,203 B2 4/2009 Laukhuf
7,537,485 B2 5/2009 Bell et al.
7,591,673 B2 9/2009 Chan et al.
D604,253 S 11/2009 Andre et al.
7,614,896 B2 11/2009 Johnson et al.
7,614,911 B2 11/2009 Hsieh et al.
7,621,744 B2 11/2009 Hayes et al.
7,624,503 B2 12/2009 Fukada
7,642,671 B2 1/2010 Mahaffey
7,648,379 B2 1/2010 Johnson et al.
7,679,222 B2 3/2010 Patterson et al.
D613,248 S 4/2010 Wu
7,722,367 B2 5/2010 Jong
7,751,206 B2 6/2010 Kosacek et al.
7,826,202 B2 11/2010 Johnson et al.
7,841,878 B2 11/2010 Johnson et al.
RE42,085 E 2/2011 Sexton
7,878,845 B2 2/2011 Byrne et al.
7,946,883 B2 5/2011 Hayes et al.
7,955,106 B1 6/2011 Crow et al.
7,955,125 B1 6/2011 Petrillo et al.
8,003,888 B2 8/2011 Owen, Sr.
8,004,115 B2 8/2011 Chapel et al.
8,007,130 B2 8/2011 Wu
8,029,307 B2 10/2011 O'Rourke
8,116,940 B2 2/2012 Keller
8,172,588 B2 5/2012 Johnson et al.
8,235,746 B2 8/2012 He
8,237,051 B2 8/2012 Sexton et al.
8,350,406 B2 1/2013 Byrne et al.
8,464,982 B2 6/2013 Raybell et al.
D692,837 S 11/2013 Knapp et al.
8,574,010 B2 11/2013 Wu
8,604,342 B2 12/2013 Solon
8,608,505 B2 12/2013 Mantay et al.
8,616,921 B2 12/2013 Byrne et al.
8,653,365 B1 2/2014 Mixon
8,680,709 B2 3/2014 Byrne et al.
8,714,999 B1 5/2014 Wu
9,146,029 B2 9/2015 Nicieja et al.
9,166,308 B2 10/2015 Byrne
9,225,131 B2 12/2015 Ernest et al.
9,360,196 B2 6/2016 Nicieja et al.
9,525,233 B2 12/2016 Staeber et al.
9,531,145 B2 12/2016 Byrne et al.
9,595,777 B2 3/2017 Byrne et al.
9,685,730 B2 6/2017 Jones et al.
9,893,482 B2 2/2018 Byrne et al.
9,885,467 B2 3/2018 Nicieja et al.
9,960,554 B2 5/2018 Strong
10,050,424 B2 8/2018 Jones et al.
10,283,919 B2 5/2019 Strong
10,283,952 B2 5/2019 Dombrowski et al.
10,333,283 B1 6/2019 Strong
10,333,284 B2 6/2019 Schneider et al.
10,482,195 B2 11/2019 Waterlot et al.
10,594,095 B2 3/2020 Strong
11,303,079 B2 * 4/2022 Byrne ..... H01R 13/46
2002/0189841 A1 12/2002 Patterson
2002/0195523 A1 12/2002 Cawley
2003/0194884 A1 10/2003 Laukhuf et al.
2004/0050573 A1 3/2004 Lin et al.
2004/0182170 A1 9/2004 Harju
2004/0256135 A1 12/2004 Liu
2005/0011657 A1 1/2005 Johnson et al.

(56) References Cited

U.S. PATENT DOCUMENTS

| | | | |
|---|---|---|---|
| 2005/0286246 | A1 | 12/2005 | Coon et al. |
| 2006/0019532 | A1 | 1/2006 | Kiss, Jr. |
| 2006/0024996 | A1 | 2/2006 | Johnson et al. |
| 2006/0234544 | A1 | 10/2006 | Chen |
| 2007/0111592 | A1 | 5/2007 | Smith |
| 2008/0012423 | A1 | 1/2008 | Mimran |
| 2008/0140565 | A1 | 6/2008 | DeBandetti et al. |
| 2008/0196936 | A1 | 8/2008 | Yamamoto et al. |
| 2009/0053926 | A1 | 2/2009 | Johnson et al. |
| 2010/0090851 | A1 | 4/2010 | Hauser |
| 2010/0139733 | A1 | 6/2010 | Jonczyk et al. |
| 2010/0328853 | A1 | 12/2010 | Johnson et al. |
| 2012/0003854 | A1 | 1/2012 | He |
| 2012/0028488 | A1 | 2/2012 | Puschnigg et al. |
| 2012/0295473 | A1 | 11/2012 | Chen |
| 2013/0037303 | A1 | 2/2013 | Wang |
| 2013/0244463 | A1 | 9/2013 | Talavasek |
| 2014/0027153 | A1 | 1/2014 | Harwath |
| 2014/0041935 | A1 | 2/2014 | Solon |
| 2014/0076628 | A1 | 3/2014 | McGrath et al. |
| 2016/0043520 | A1 | 2/2016 | Strong |
| 2016/0079721 | A1 | 3/2016 | Jones et al. |
| 2018/0248325 | A1 | 8/2018 | Strong |
| 2018/0316167 | A1 | 11/2018 | Schneider et al. |
| 2019/0148850 | A1 | 5/2019 | Byrne et al. |
| 2019/0273346 | A1 | 9/2019 | Strong |

* cited by examiner

USER ACCESS / CONVENIENCE POWER OPTION

USER ACCESS POWER OPTION

MODULAR ELECTRICAL SYSTEM

CROSS REFERENCE TO RELATED APPLICATION

The present application in a continuation of U.S. patent application Ser. No. 16/884,690, filed May 27, 2020, now U.S. Pat. No. 11,303,079, issued Apr. 12, 2022, which claims the benefit of U.S. provisional application, Ser. No. 62/853,461, filed May 28, 2019, which is hereby incorporated herein by reference in its entirety.

FIELD OF THE INVENTION

The present invention relates to electrical wiring extensions and, more particularly, to electrical wiring extensions for use in exposed areas such as along floor surfaces or along work surfaces.

BACKGROUND OF THE INVENTION

Extension cords are commonly used for temporarily routing electricity or electrical signals from a power or data source to a different area or location, such as in a home or office building. When extension cords are laid across flooring or walking areas, floor runners in the form of protective covers are sometimes used to temporarily house the extension cord in an effort to reduce tripping hazards.

SUMMARY OF THE INVENTION

A modular electrical system facilitates the convenient routing of electrical power and/or data from one area to another within a work area, such as along work surfaces and/or along floor surfaces. A user may select a desired number of outlet assemblies and select a desired number of jumpers and junctions in order to provide the desired number and location of outlet assemblies in a work area. Different connectors may be compatible with one another so that jumpers may be exchanged for outlet assemblies and vice versa, and junctions may be added as desired to extend along greater distances or to provide a greater number of outlet assemblies in a given area.

In one form, a modular electrical system includes an electrical power infeed, an electrical distribution assembly, a power or data unit, and a power jumper cable. The electrical power infeed includes an electrical input plug and a first electrical output connector. The electrical distribution assembly includes a first electrical input connector for receiving the first electrical output connector, an electrical output assembly, and a plurality of electrical conductors extending between the first electrical input connector and the electrical output assembly. The electrical output assembly includes at least one branch output connector and a first jumper output connector. The power or data unit includes a branch plug connector for engaging the branch output connector, an electrical power or data receptacle for supplying power or data to an electrical or electronic device, and a flexible branch extension wire that extends from the branch plug connector to the electrical power or data receptacle. The power jumper cable includes a jumper input connector for connection to the first jumper output connector, and a second jumper output connector.

In another form, the present invention provides a modular electrical floor runner that can be assembled from pieces to a desired length, which incorporates electrical wiring internally (such as for power and/or data) and power or data outlets at spaced intervals along the length of the runner. The floor runner may be assembled from modular runs and junction pieces to achieve a desired length, configuration (shape), and number of outlets for a desired application. The floor runner may include a customizable power/data outlet housing that facilitates use of a desired number or type (or combination) of power and/or data outlets. The floor runner typically includes a low-profile extrusion that is substantially rigid to resist damage or lifting from a floor surface, and can be used as a permanent or semi-permanent wiring extension device, such as for use in reconfigurable office spaces.

These and other objects, advantages, purposes and features of the present invention will become apparent upon review of the following specification in conjunction with the drawings.

DESCRIPTION OF THE PREFERRED EMBODIMENTS

Figure 1:
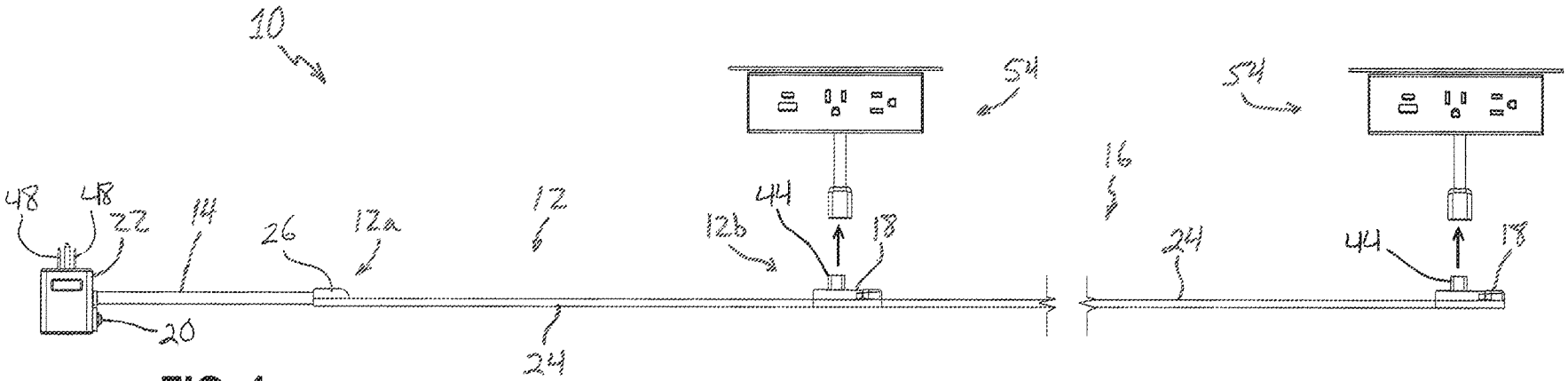
FIG. 1 is a right side elevation of an electrical distribution system in accordance with the present invention, in the form of a modular floor runner assembly.
Figure 2:
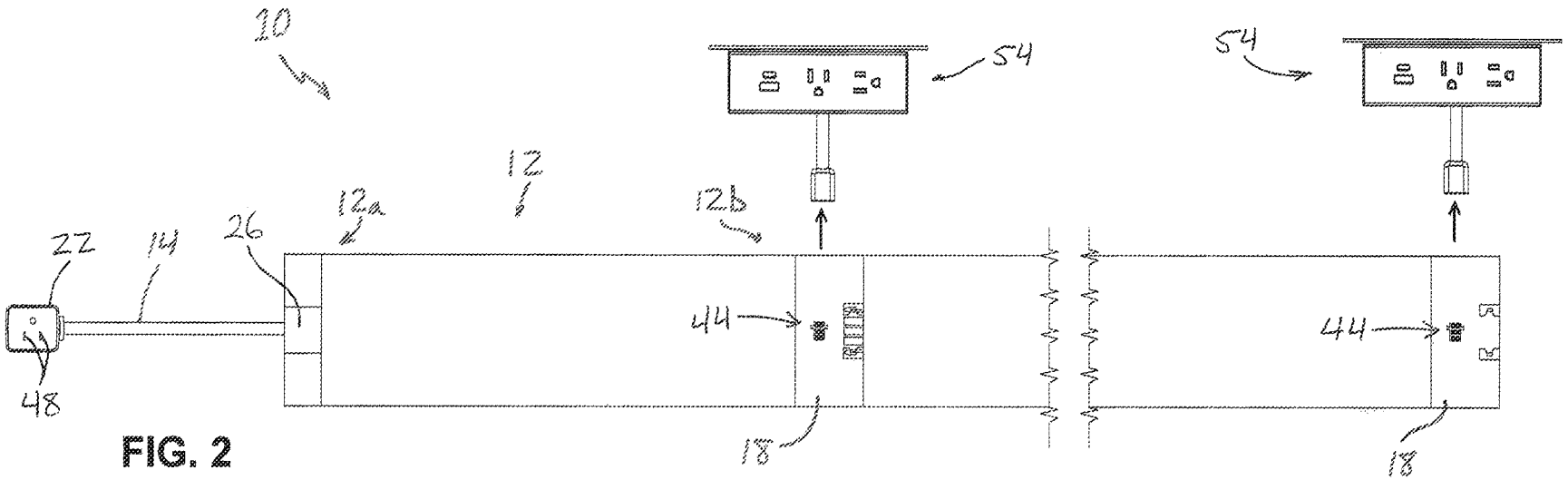
FIG. 2 is a top plan view of the modular floor runner assembly of FIG. 1.
Figure 7:
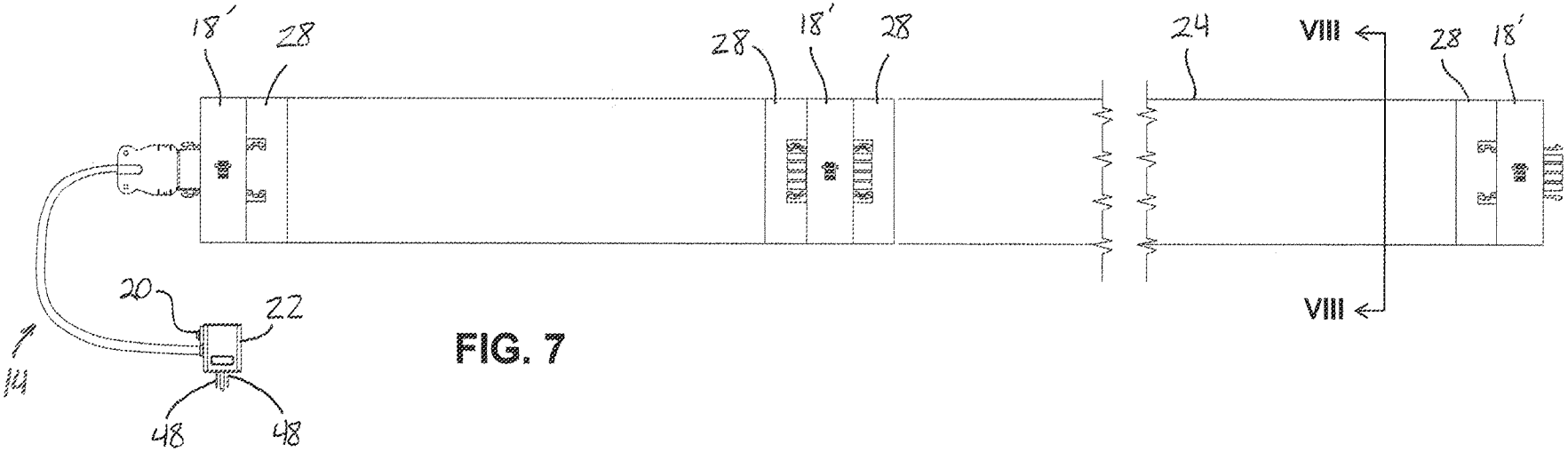
FIG. 7 is a top plan view of the floor runner modules of FIG. 6, and including a power infeed cord.

Referring now to the drawings and the illustrated embodiments depicted therein, an electrical distribution system in the form of a modular electrical floor runner assembly 10 is provided for routing electrical wiring, such as power and/or data wiring, to a location where power and/or data outlets are desired (FIGS. 1, 2, and 7). The modular floor runner assembly 10 is assembled from a first or upstream floor runner module 12 that includes an electrical power infeed 14 at its upstream end 12*a*, one or more downstream floor runner modules 16, and one or more junction modules 18 that are interposed between adjacent floor runner modules 12, 16. By assembling a desired number of downstream floor runner modules 16 with an appropriate corresponding number of junction modules 18, a user may configure the assembly 10 to reach any desired location within a work area and provide electrical power and/or electronic data in one or more desired locations within the work area. The electrical capacity of wiring and connectors disposed along the floor runner modules 12, 16 and the junction modules 18 can be made substantially higher than necessary, while a circuit breaker 20 at a power plug 22 of the electrical power infeed 14 (FIG. 3) ensures that electrical loads along the modular electrical floor runner assembly 10 cannot exceed the capacity of a circuit from which the assembly 10 receives power.

Figure 3:
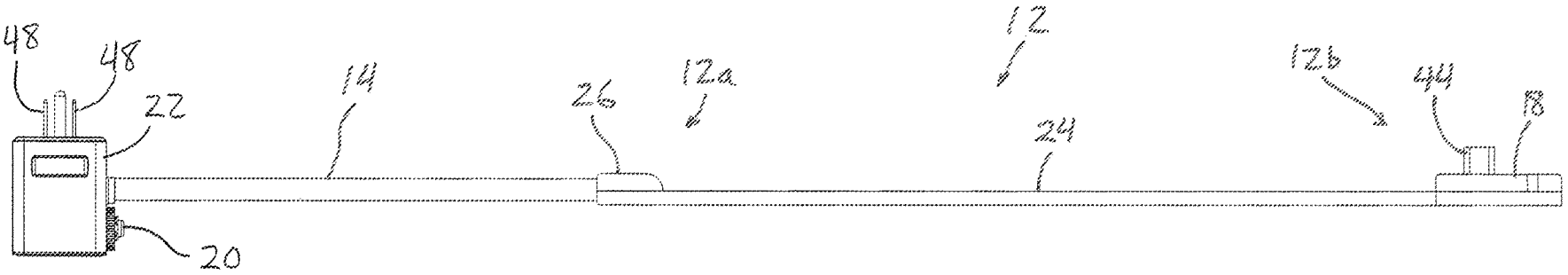
FIG. 3 is an enlarged right side elevation of a first module of the floor runner assembly that is designated III in FIG. 1.
Figure 4:
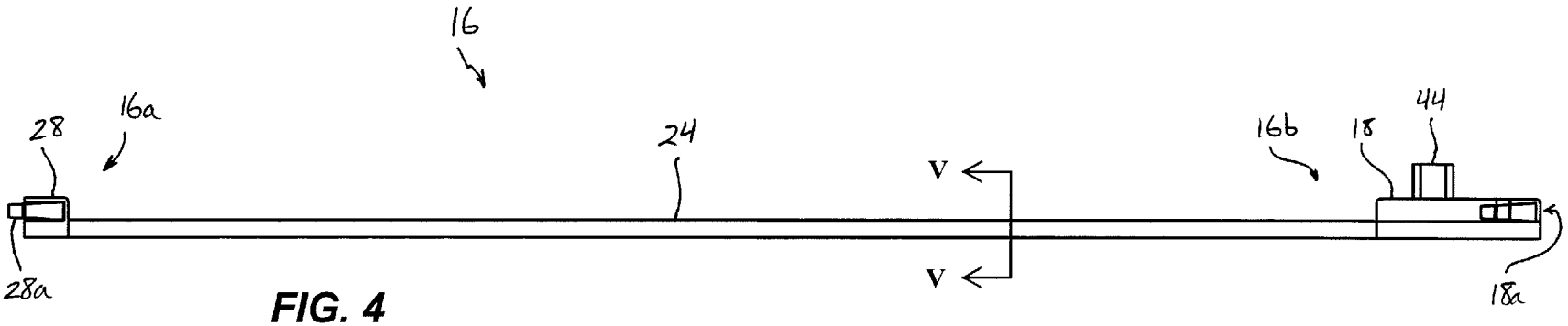
FIG. 4 is an enlarged right side elevation of a module of the floor runner assembly of FIG. 1.
Figure 6:
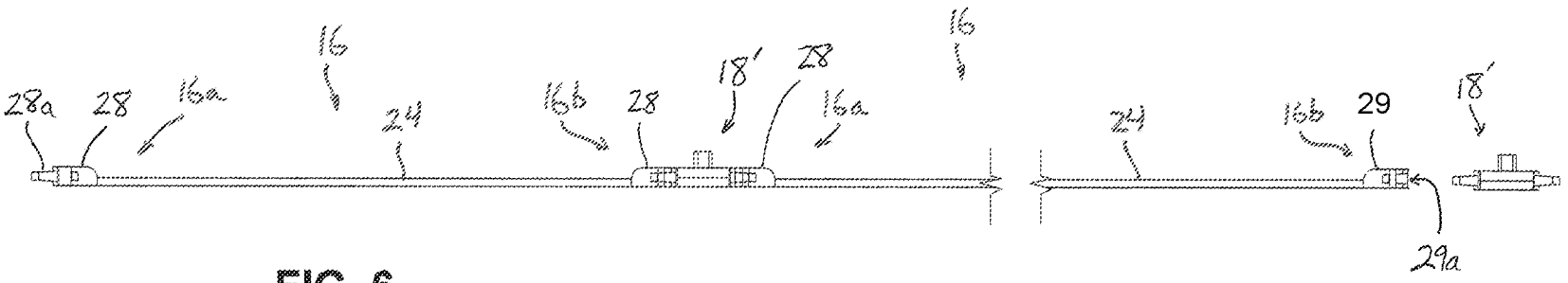
FIG. 6 is a right side elevation of a series of connected floor runner modules of another modular floor runner assembly in accordance with the present invention.

The first or upstream floor runner module 12 includes a rigid elongate housing 24 having a power infeed coupler 26 at its upstream end 12*a*, for connection to the electrical power infeed 14, such as shown in FIG. 3. The upstream floor runner module 12 further includes one of the junction modules 18 coupled at its downstream end 12*b*. Each of the downstream floor runner modules 16 also includes a rigid elongate housing 24, which may be identical to the housing 24 of the first floor runner module 12. In the embodiment of FIGS. 1-4, each downstream floor runner module 16 has an upstream coupler 28 at an upstream end 16*a*, and a junction module 18 at a downstream end 16*b*, such as shown in FIG. 4. The upstream couplers 28 include projections 28*a* that are configured to electrically and mechanically engage a downstream receptacle 29*a* of a downstream coupler 29 so that the downstream floor runner modules 16 may be interchangeable with one another and/or may couple to a junction module 18 or a double-ended (mirror image) junction module 18' (FIG. 6). Each junction module 18 further includes a branch connector or receptacle 44 along an upper surface of the junction module, such as shown in FIG. 4. Branch receptacles 44 are configured to be electrically engaged by respective power and/or data units 54, as will be described below.

Figure 5:
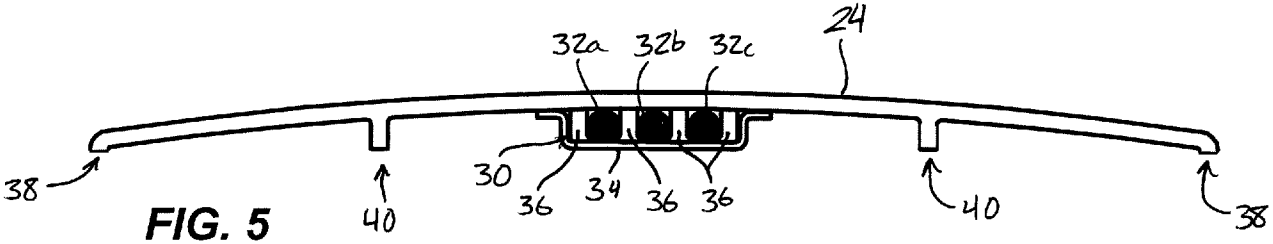
FIG. 5 is an enlarged sectional view of the third module, taken along Section V-V in FIG. 4.

Referring to FIG. 5, the rigid elongate housings 24 of the floor runner modules 12, 16 define elongate channels 30 that contain and protect a plurality of electrical conductors 32*a-c* disposed in the elongate channel. In the illustrated embodiment, elongate channels 30 are defined below a top central region of the elongate housing 24 and above an elongate U-shaped channel member 34 that is coupled to an underside of the elongate housing's top central region. Optionally, a plurality of spacers 36 are interposed between the electrical conductors 32*a-c*, and between upright sidewalls of the U-shaped channel member and the outboard electrical conductors 32*a*, 32*c* (FIG. 5). Additional circuits may be incorporated into the floor runner modules as desired, such as shown in FIG. 8 in which four conductors 32*a-d* are incorporated, which include two separate line conductors on separate circuits, in addition to a neutral conductor and a ground conductor.

Figure 8:
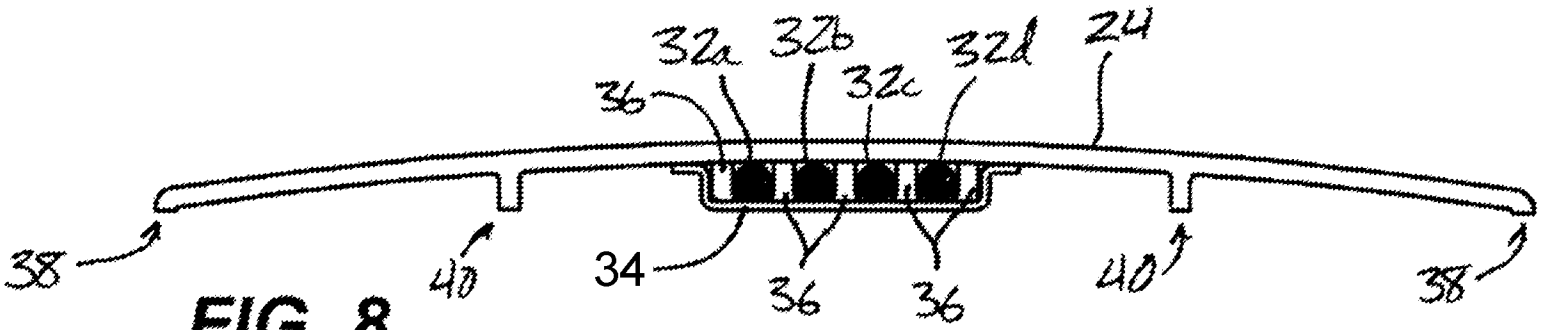
FIG. 8 is an enlarged sectional view of a floor runner module, taken along Section VIII-VIII in FIG. 7.

To provide crush-resistance and added rigidity and strength, the elongate housing 24 includes downwardly-extending outboard ends 38 and downwardly-extending intermediate support walls 40 (FIGS. 5 and 8). Elongate housings 24 may be made from extruded or molded aluminum or reinforced polymeric material, for example, or any suitable material that provides strength and crush-resistance. Optionally, a tread pattern may be formed along an upper surface of each elongate housing 24, which may be positioned within a walking area and directly walked upon or rolled over by persons or equipment in the walking area.

Figure 9:
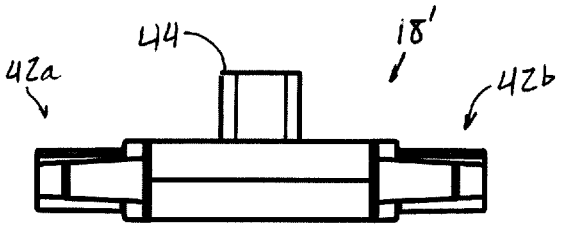
FIG. 9 is a right side elevation of a junction piece of one of the floor runner modules of FIG. 6.
Figure 10:
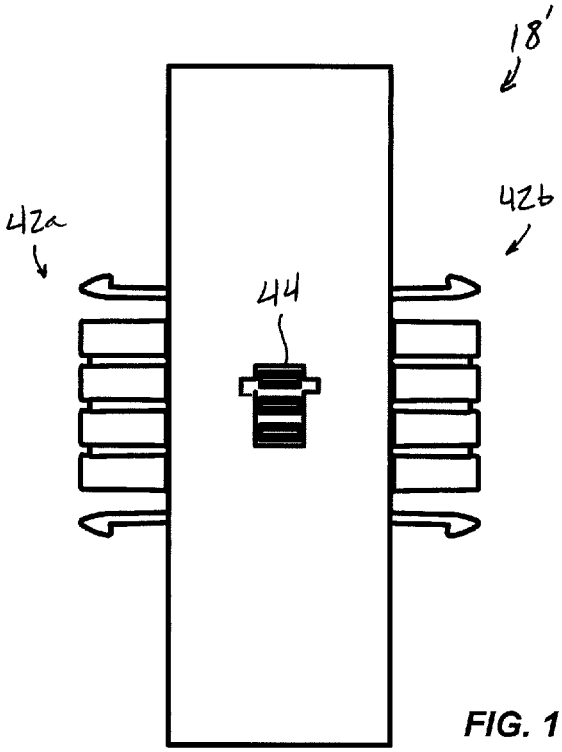
FIG. 10 is a top plan view of the junction piece of FIG. 9.
Figure 11:
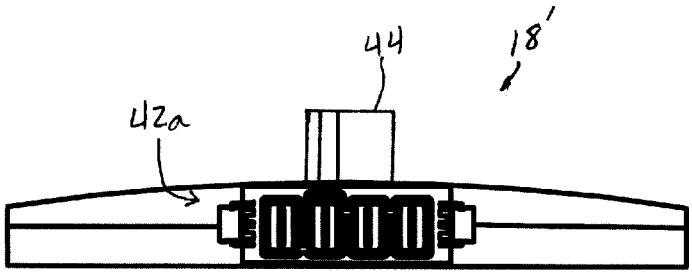
FIG. 11 is an end elevation of the junction piece of FIG. 9.

In the embodiment of FIGS. 6 and 7, one double-ended junction module 18' is provided between each adjacent floor runner modules 12, 16, and includes end connectors that are received in corresponding couplers 28' at the adjoining ends of the elongate housings 24. Referring to FIGS. 9-11, each double-ended junction module 18' includes an upstream junction connector 42*a* configured to engage a downstream electrical runner connector (not shown) at the downstream end 12*b* of the first floor runner module 12 or at the downstream end 16*b* of any of the downstream floor runner modules 16. Each double-ended junction module 18' further includes a downstream junction connector 42*b* that is configured to engage an upstream electrical runner connector (not shown) at the upstream end 16*a* of any of the downstream floor runner modules 16. Each double-ended junction module 18' further includes a branch receptacle 44 along an upper surface of the junction module, with the branch receptacle 44 being in electrical communication with both the upstream and downstream junction connectors 42*a*, 42*b* of that double-ended junction module 18'. The upstream connector 42*a* may be engaged by a compatible downstream connector 46 of the electrical power infeed 14 to supply power (or data signals) to the conductors 32*a-c* and the branch receptacles 44 of the modular electrical floor runner assembly 10.

Optionally, the junction modules may be shaped to provide a bend or curve between adjacent floor runner modules. Junction modules can also be formed as blanks in which they act only as a connection interface between adjacent floor runner modules 12, 16, with no branch receptacle 44 provided. It is further envisioned that junction modules could be permanently attached to one floor runner module, so that the junction modules are readily attachable and detachable from only one other floor runner module.

Optionally, the upstream junction connector 42*a* is identical to downstream junction connector 42*b* so that the double-ended junction module 18' may be installed in either of two orientations between adjacent floor runner modules, which in turn may also be installed in either of two orientations. That is, although each floor runner module 16 and each junction connector 42 can be said to have an "upstream end" and a "downstream end" when assembled together, the orientations of these components can be rotated 180 degrees without affecting their connectability or function.

As noted above, the electrical wiring and various connectors of the modular electrical floor runner assembly 10 may be designed with a high electrical power capacity so that many downstream floor runner modules 16 and junction modules 18 or 18' can be assembled together in a work area without creating capacity problems for the wiring and connectors within the assembly 10. It will be appreciated that providing many branch receptacles 44 that provide access to electrical power along the assembly 10 will increase the likelihood that users will connect enough electrical power consumers to the assembly 10 so that the electrical power capacity of the circuit(s) supplying power to the assembly 10 will be exceeded. To prevent overloading the circuit(s) supplying power to the assembly 10, circuit breaker 20 is selected to have an equal power capacity or a lower power capacity than the rest of the assembly 10. The circuit breaker 20 is associated with at least one prong 48 of the plug 22 and has a capacity selected to disconnect electrical continuity between that prong 48 and a corresponding one of the electrical conductors 32*a-c* in the first floor runner module 12. Thus, to prevent overload conditions reaching a circuit supplying power to the assembly 10, the runner modules 12, 16 and the junction modules 18 or 18' have a first (higher) rated electrical capacity when they are assembled together, while the circuit breaker 20 has a second rated electrical capacity that is less than or equal to the first rated electrical capacity.

Figure 12:
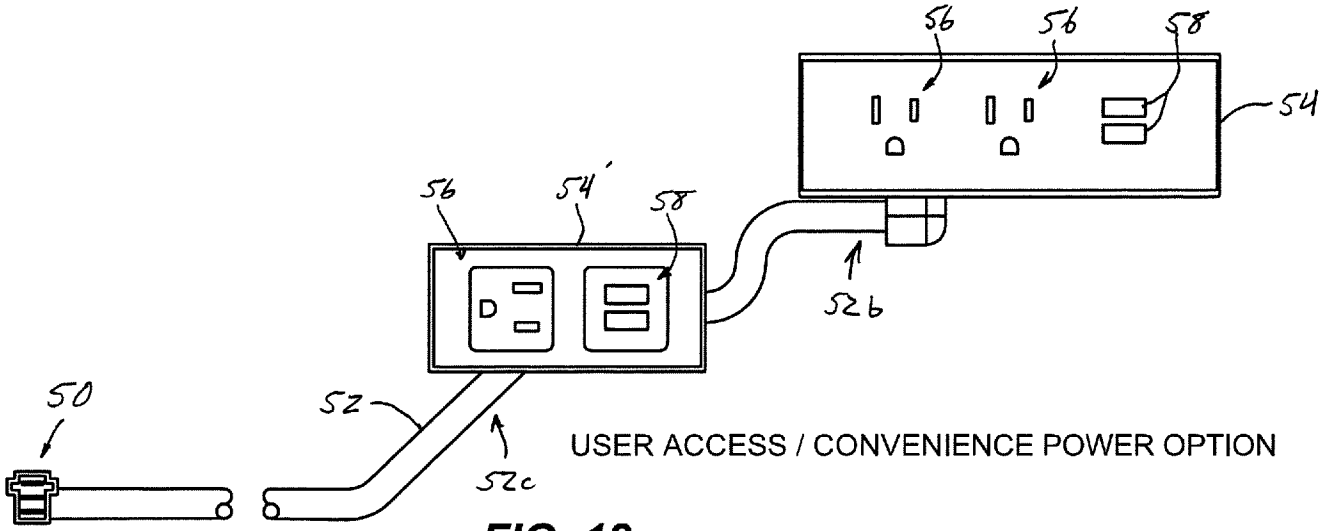
FIGS. 12 and 13 are side elevations of two power outlet branches that are compatible for use with the floor runner modules of FIGS. 1 and 6.
Figure 13:
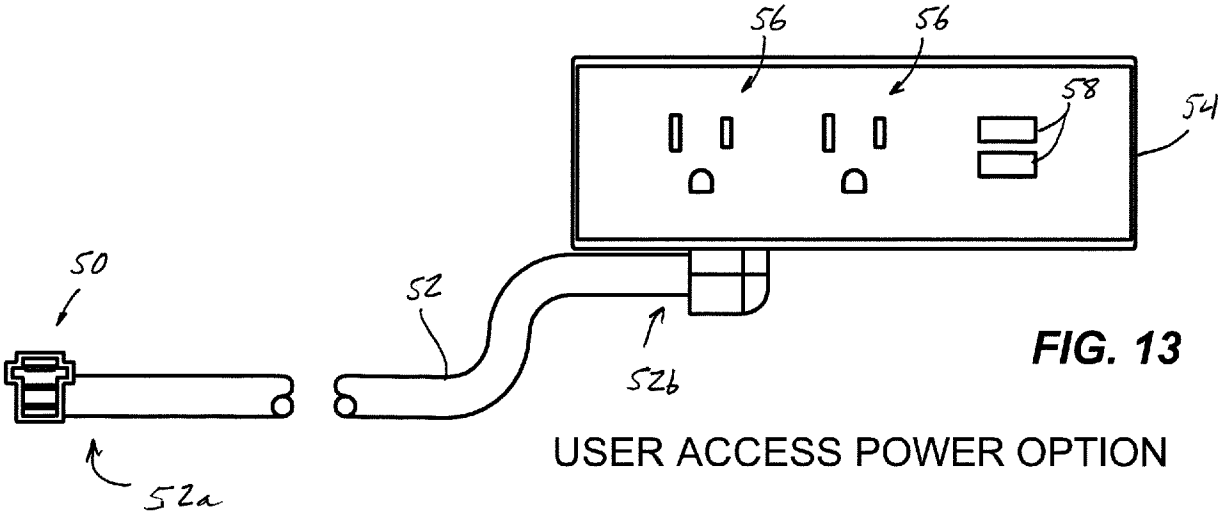

The branch receptacles 44 are positioned in respective upper surfaces of the junction modules 18, 18' and face upwardly, such as shown in FIGS. 1-4, 6, 7, and 9-11. However, it is envisioned that the branch receptacles may be positioned at or along the junction modules' side surfaces, facing laterally or horizontally (e.g., having generally horizontal plug-in directions). These branch receptacles 44 can receive compatible branch plugs 50 at proximal ends 52*a* of flexible branch extensions 52, such as shown in FIGS. 12 and 13. Each flexible branch extension 52 has a distal end 52*b* fitted with a power and/or data unit 54 that may include one or more high conventional voltage AC power outlets 56 (such as 110V AC or 220V AC simplex outlets) and/or one or more conventional low voltage DC power outlets 58 (such as USB power outlets). It is further envisioned that electronic data receptacles and/or wireless power outputs may be mounted in a power and/or data unit. Optionally, one or more additional power and/or data units 54' may be placed along an intermediate region 52*c* of the flexible branch extension 52. The flexible branch extension 52 typically includes an outer protective casing or jacket made of rubber or similar material, which is optionally covered by flexible metal conduit, a woven fabric covering, or the like, for added protection. Optionally, the flexible branch extension 52 could be routed through rigid metal or plastic conduit. The power and/or data units 54, 54' are typically placed or mounted along work surfaces such as tables, desks, shelves, partition walls, or the like, within a work area. Suitable power and/or data units 54, 54' are available, for example, from Byrne Electrical Specialists, Inc. of Rockford, Mich.

It will be appreciated that, aside from the plug 22 with conventional prongs 48 and the power and/or data units 54, 54' with conventional power or data receptacles 56, 58, in the illustrated embodiment every electrical connector along the modular electrical floor runner assembly 10 is an unconventional or proprietary or custom connector that is incompatible with conventional connectors such as standard NEMA plugs and outlets. This selection of custom connectors prevents users in a work area from connecting a standard extension cord or electrical consumer directly to one of the branch receptacles 44. It may be desirable to prevent the use of conventional or standard extension cords because, as noted above, the assembly 10 is designed to have excess electrical capacity or rating between the power and/or data units 54, 54' and the electrical power infeed 14, with the circuit breaker 20 in the plug 22 being the limiting factor for the capacity of the assembly 10. Conventional or standard extension cords may have lower electrical capacity than the wiring and connectors specifically designed for the assembly 10, which would potentially compromise the capacity of the assembly if permitted.

Figure 14:
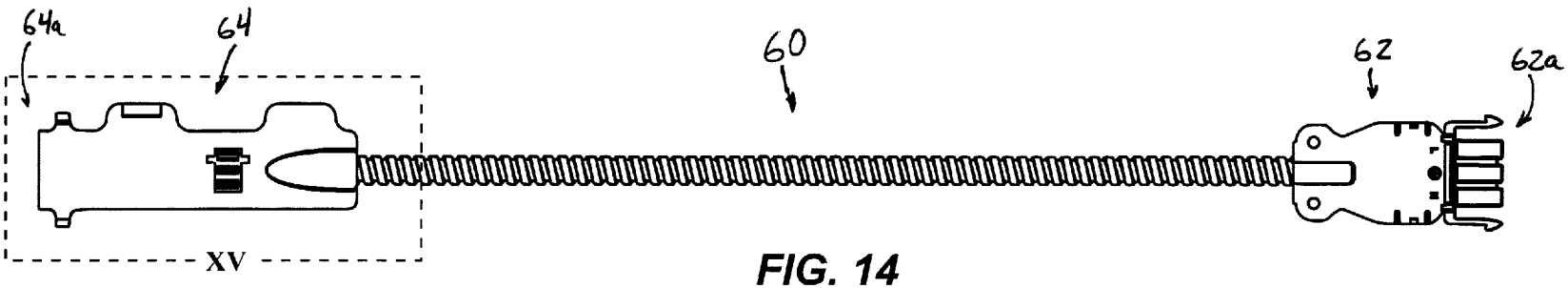
FIG. 14 is a side elevation of a jumper wire assembly compatible for use with the floor runner modules of FIGS. 1 and 6.
Figure 16:
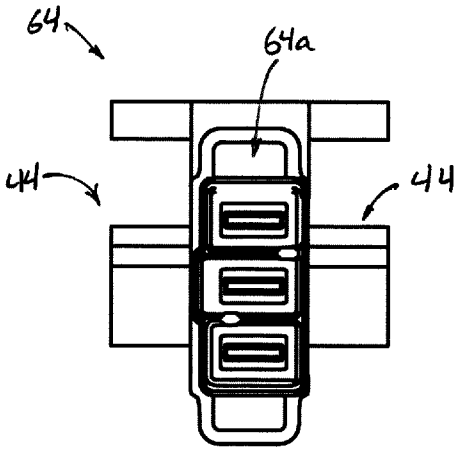
FIG. 16 is an end elevation of the connector and branch output assembly of FIG. 15.
Figure 15:
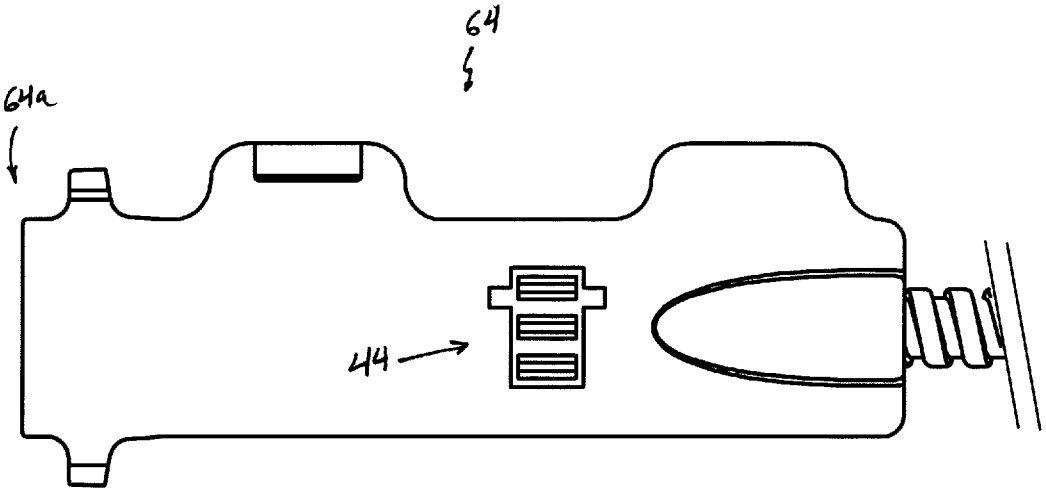
FIG. 15 is an enlarged view of a connector and branch output assembly at the area designated XV in FIG. 14.
Figure 17:
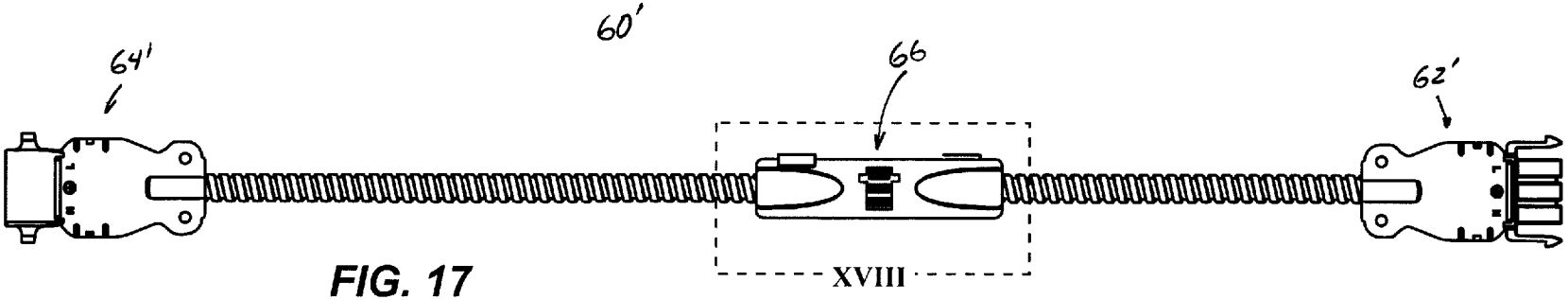
FIG. 17 is a side elevation of another jumper wire assembly compatible for use with the floor runner modules of FIGS. 1 and 6, including a branch output assembly along its midsection.
Figure 18:
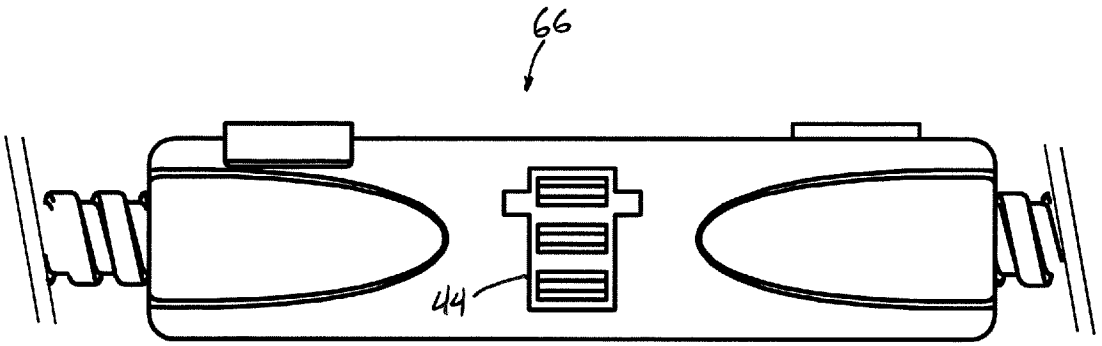
FIG. 18 is an enlarged view of the midsection branch output assembly at the area designated XVIII in FIG. 17.

Optionally, and with reference to FIGS. 14-16, a power in/out jumper cable 60 serves as an electrical distribution assembly, and includes a first connector 62 that is configured for engagement with electrical runner connectors (not shown) at either end 12*a*, 12*b* or 16*a*, 16*b* of the first floor runner module 12 or any of the downstream floor runner modules 16. The connector interface 62*a* of the first connector 62 may be configured identically to the upstream junction connector 42*a* and downstream junction connector 42*b* of the double-ended junction module 18', although it will be appreciated that in the illustrated embodiment of FIGS. 14-16, connector interface 62*a* has a 3-terminal 3-wire configuration, whereas the junction connectors 42*a*, 42*b* in the embodiment of FIGS. 9 and 10 have a 4-terminal 4-wire configuration. Opposite the first connector 62 is a second connector 64 including a distal end connector interface 64*a* for receiving or conveying power and/or data, and a pair of branch receptacles or connectors 44 extending outwardly from opposite sides of the second connector 64, such as shown in FIG. 16. The power in/out jumper cable 60 can be used to supply power or data into the system 10, in a similar manner as the electrical power infeed 14 described above, but with connectors 62, 64 that are specifically designed to be non-standard, to ensure appropriate electrical compatibility. The power in/out jumper cable 60 can also be used to supply power or data out of the system 10, in a similar manner as the electrical power infeed 14 described above, but with connectors 62, 64 that are specifically designed to be non-standard, to ensure appropriate electrical compatibility and avoid connections to incompatible cords or wiring.

A similar power in/out jumper cable 60' can serve as an electrical distribution assembly, including a first connector 62' and a second connector 64' that are configured for engagement with electrical runner connectors (not shown) at either end 12*a*, 12*b* or 16*a*, 16*b* of the first floor runner module 12 or any of the downstream floor runner modules 16. The power in/out jumper cable 60' includes an intermediate connector 66, between the first and second connectors 64', that provides one or more branch receptacles or connectors 44 that are compatible with the branch plugs 50 of the flexible branch extensions 52. The power in/out jumper cables 60, 60' can thus function as additional power output points for branch extensions, and may be used to add flexibility to the locations or placement of floor runner modules 12, 16 within the modular electrical floor runner assembly 10.

Figure 19:
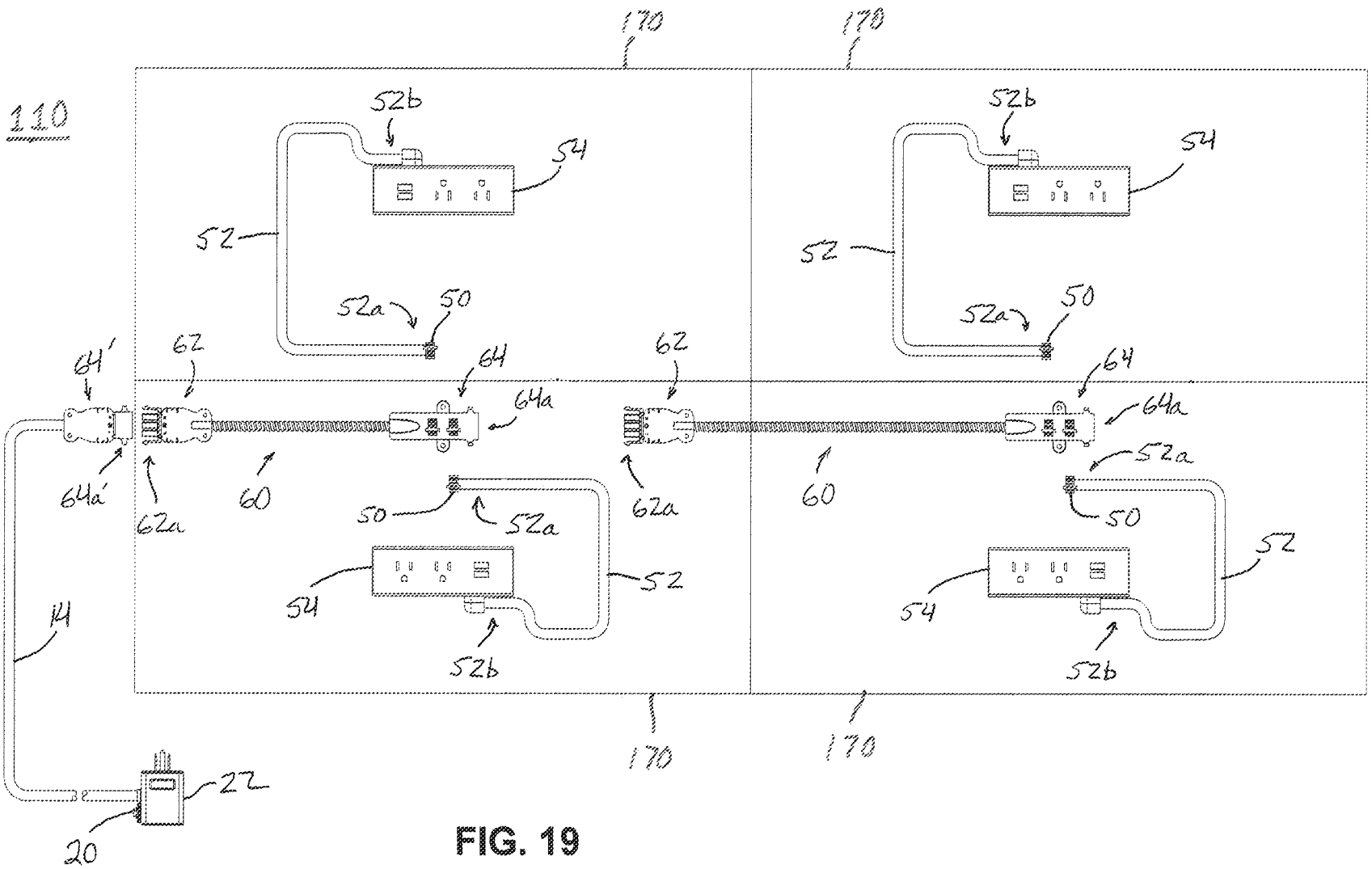
FIG. 19 is an exploded bottom plan view of another electrical distribution system and four table surfaces.
Figure 20:
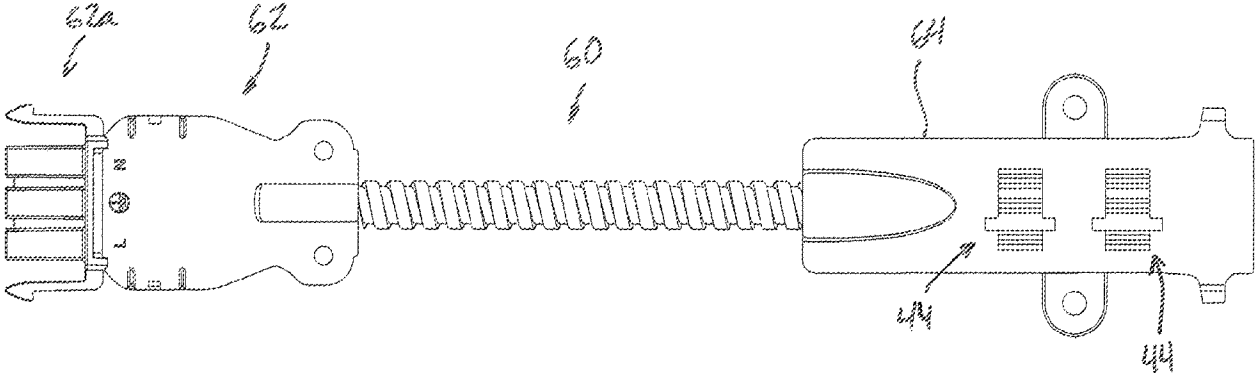
FIG. 20 is a plan view of a jumper wire assembly of the electrical distribution system of FIG. 19.
Figure 21:
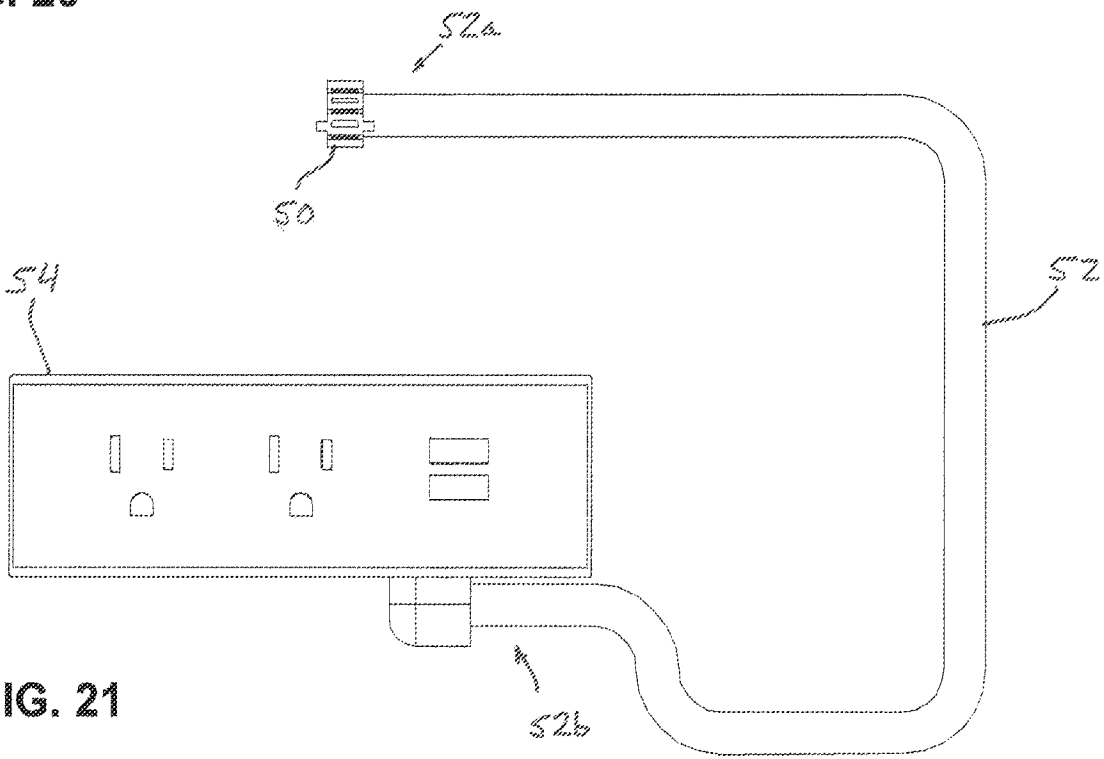
FIG. 21 is an elevation view of a power outlet branch of the electrical distribution system of FIG. 19.

Additional combinations of wiring and connectors may be used to route electrical power along surfaces such as flooring, walls, or underneath tables, desks, countertops, or the like. Referring to FIG. 19, another electrical distribution system 110 is configured for providing electrical power and/or electronic data to four table surfaces 170. The electrical distribution system 110 does not include protective floor runner assemblies, and instead is made up of components configured for being secured to the table surfaces 170, such as the undersides thereof. An electrical power infeed 14 receives electrical power from plug 22 having a circuit breaker 20, and directs that power to a second connector 64 having a connector interface 64*a*. The power infeed's connector interface 64*a* is coupled to the compatible connector interface 62*a* of a first connector 62, which is part of a power in/out jumper cable 60 that includes a second connector 64 having a connector interface 64*a* and a pair of branch receptacles 44 (FIG. 20). The connector interface 64*a* couples to another connector interface 62*a* of a first connector 62 at the end of another power in/out jumper cable 60, which may serve as another electrical distribution assembly in addition to an extension. A power and/or data unit 54 is electrically coupled to each branch receptacle 44 of the second connector 64 via its branch plug 50 (FIGS. 19 and 21). It will be appreciated that additional sets of power in/out jumper cable 60' and power and/or data unit 54 may be connected until a desired number of power and/or data units 54 have been provided for the desired number of tables 170 or work surfaces.

Figure 22A:
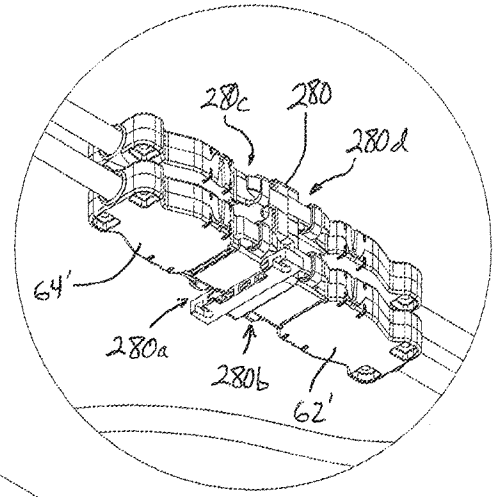
FIG. 22A is an enlarged view of the area designated 'A' in FIG. 22.
Figure 22:
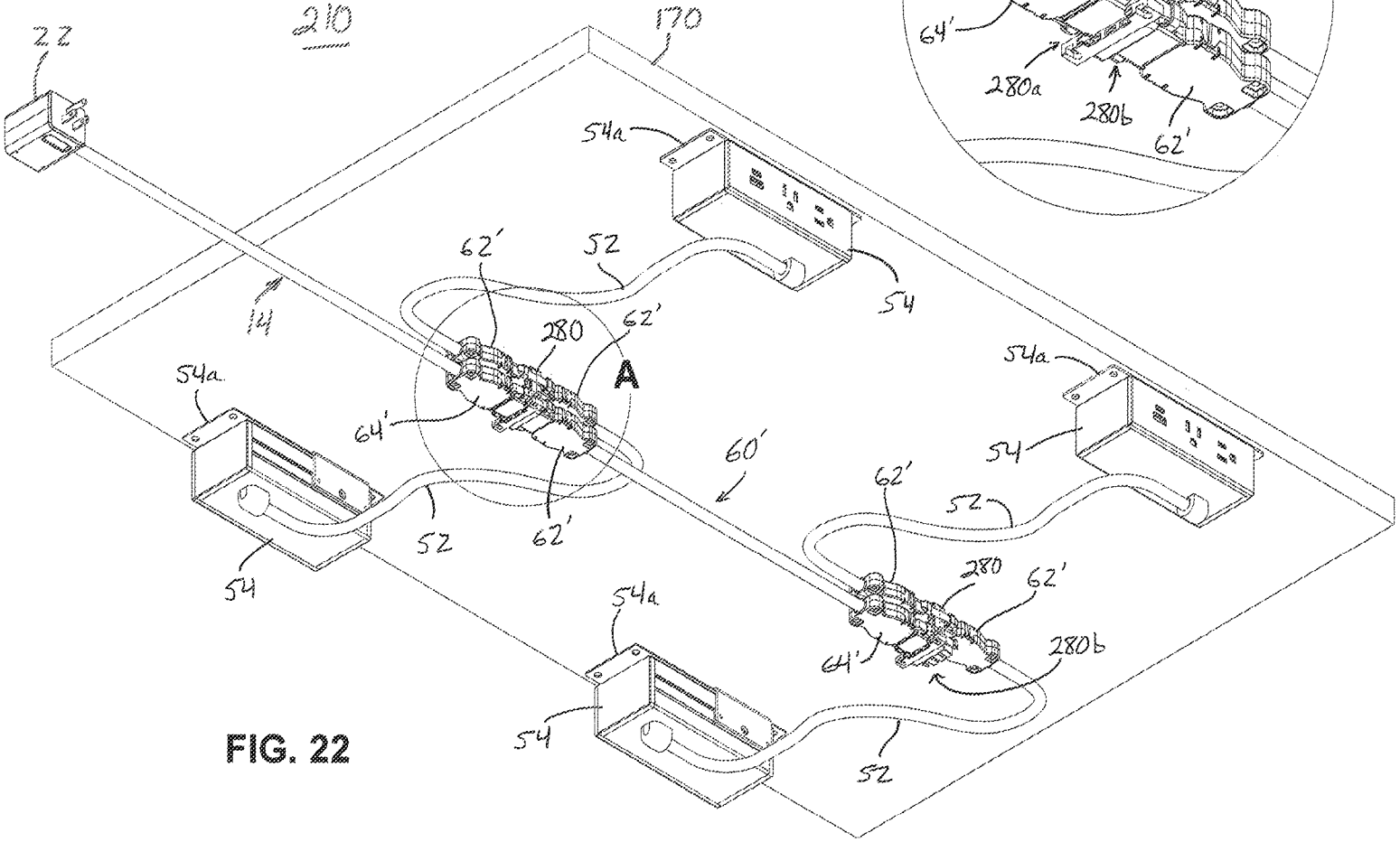
FIG. 22 is a bottom perspective view of another electrical distribution system in accordance with the present invention, shown coupled to the underside of a table surface.
Figure 23:
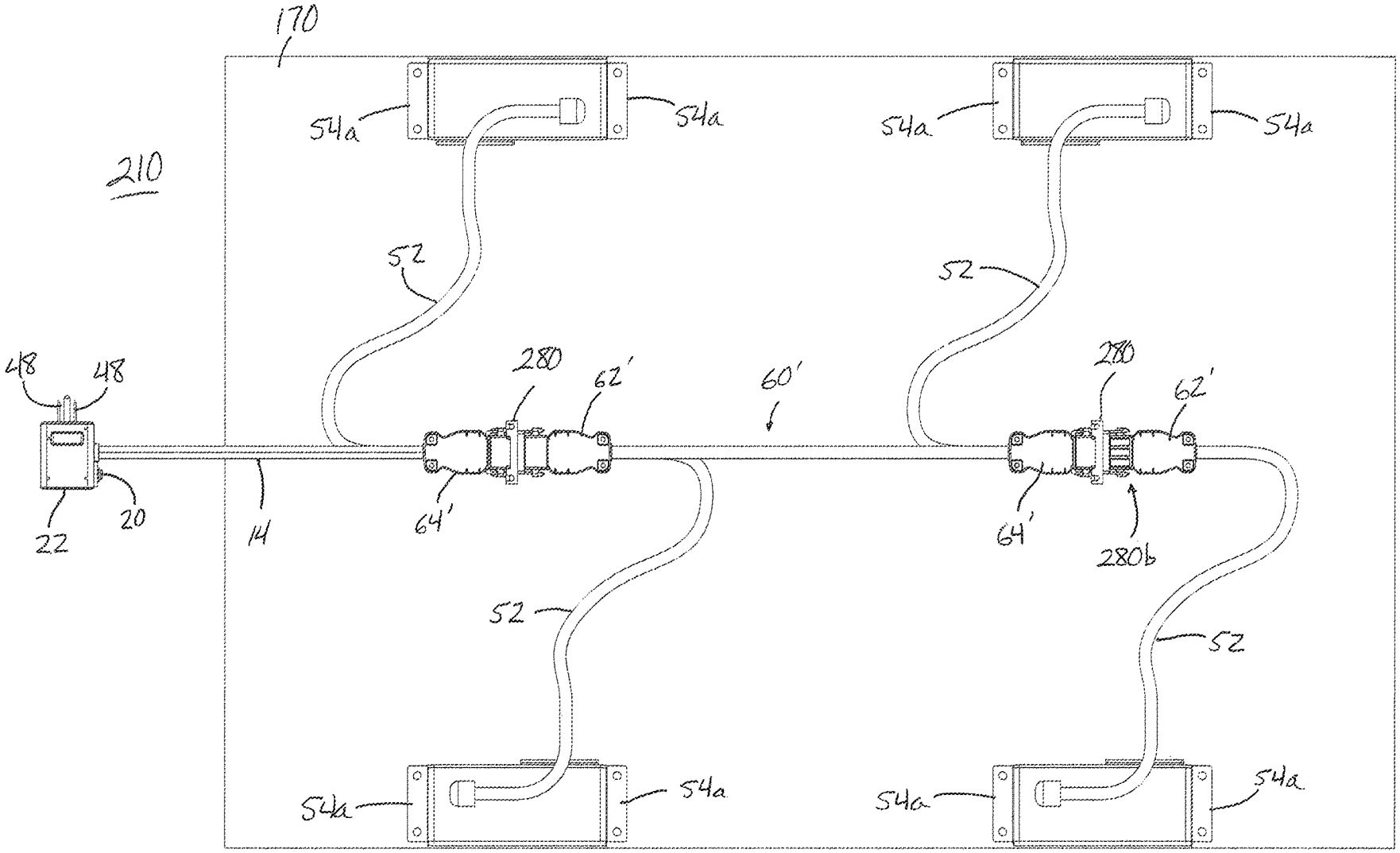
FIG. 23 is a bottom plan view of the electrical distribution system of FIG. 22.
Figure 24:
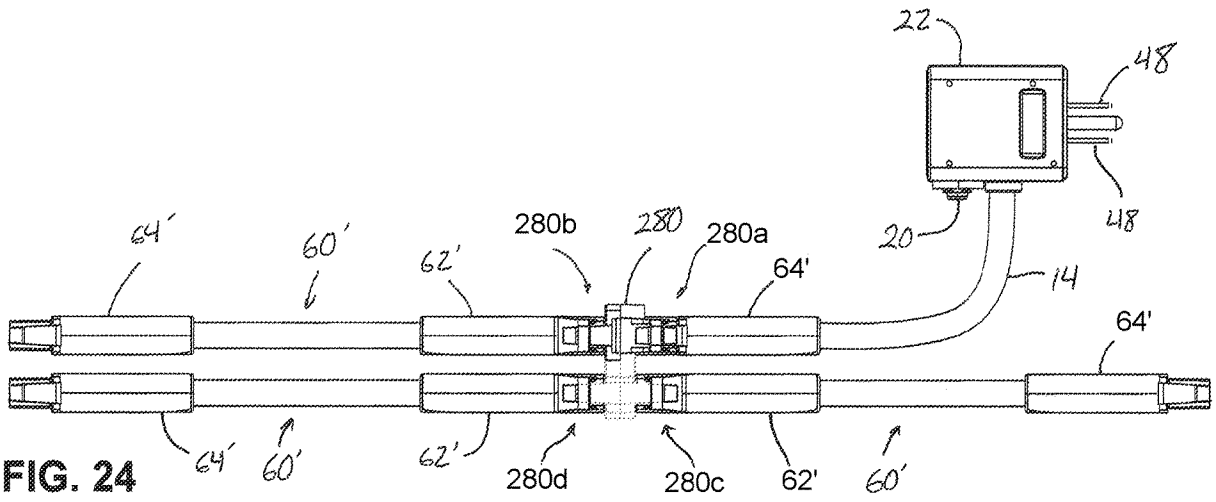
FIG. 24 is an elevation view of a four-way junction coupled to an electrical power infeed, and three jumper wire assemblies, of the electrical distribution system of FIG. 19.
Figure 25:
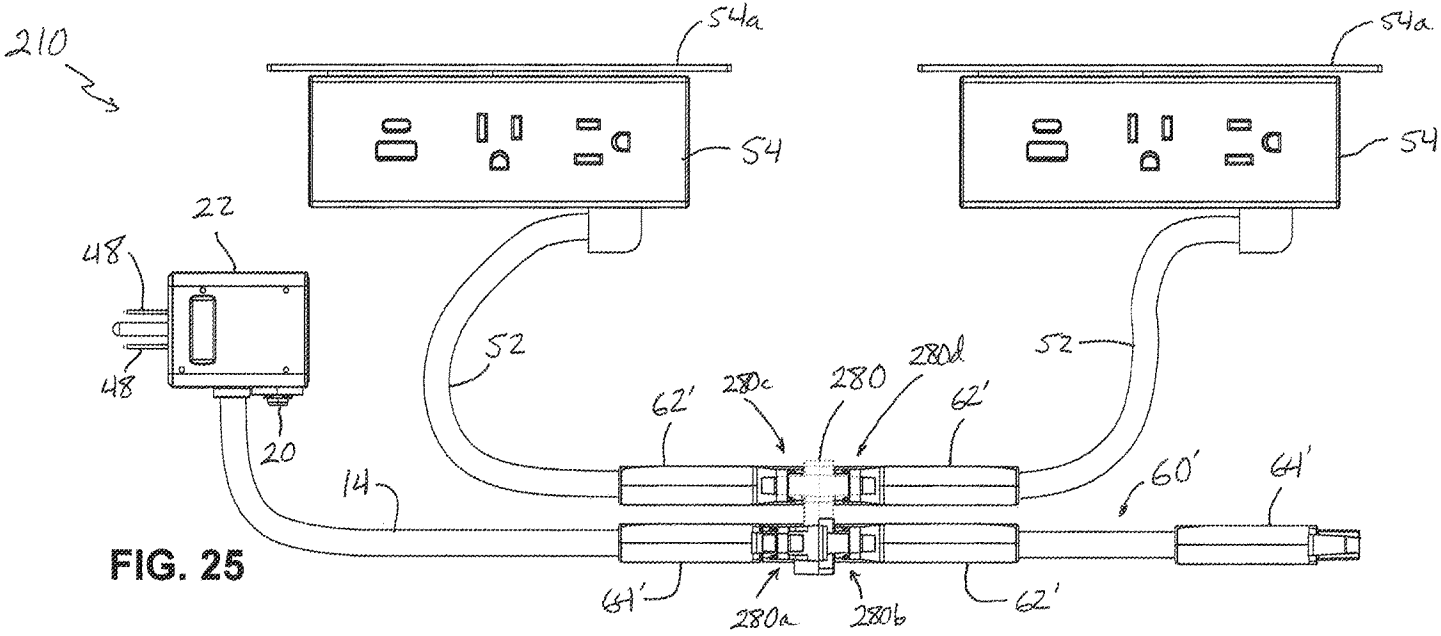
FIG. 25 is an elevation view of a four-way junction coupled to an electrical power infeed, one jumper wire assembly, and two power outlet branches, of the electrical distribution system of FIG. 19.

Referring now to FIGS. 22-23, another electrical distribution system 210 is configured for providing electrical power and/or electronic data to a table surface 170. The distribution system 210 utilizes an H-shaped electrical splitter connector 280 (best shown in FIGS. 22A, 24 and 25) having a power input receptacle 280*a*, and three power output receptacles 280*b-d* that may be configured identically to one another. In the illustrated embodiment of FIGS. 22-23 and 25, the H-shaped electrical connector's power input receptacle 280*a* is engaged by the second connector 64' opposite a plug 22 of an electrical power infeed 14. A power in/out jumper cable 60' includes a first connector 62' for engagement with the first power output receptacle 280*b* and a second connector 64' for engagement with the power input receptacle 280*a* of another H-shaped electrical connector 280. A second power output receptacle 280*c* and third power output receptacle 280*d* are engaged by respective power connectors 62' associated with flexible branch extensions 52 and power and/or data units 54, the latter being coupled to an underside of the table surface 170 using brackets 54*a*. Thus, the H-shaped electrical connector 280 acts as a splitter by providing power outputs to a desired number of electrical power units 54 and/or to a downstream power in/out jumper cable 60' and subsequent connectors 280 and power units 54 as desired. For example, the first power output receptacle 280*b* of a downstream electrical connector 280 may be left open as shown, or may be used to provide power to a third power unit 54 (not shown). The H-shaped electrical connectors 280 may also be used to direct power to two or three power in/out jumper cables 60', such as shown in FIG. 24. Optionally, second connectors 64' are configured for connection to a modular electrical floor runner assembly such as described above, so that power and/or data can be directed along work surfaces and then down along floor surfaces where needed (e.g., through a walking space), and optionally back up to work surfaces at an opposite end of the floor runner assembly.

Figure 26A:
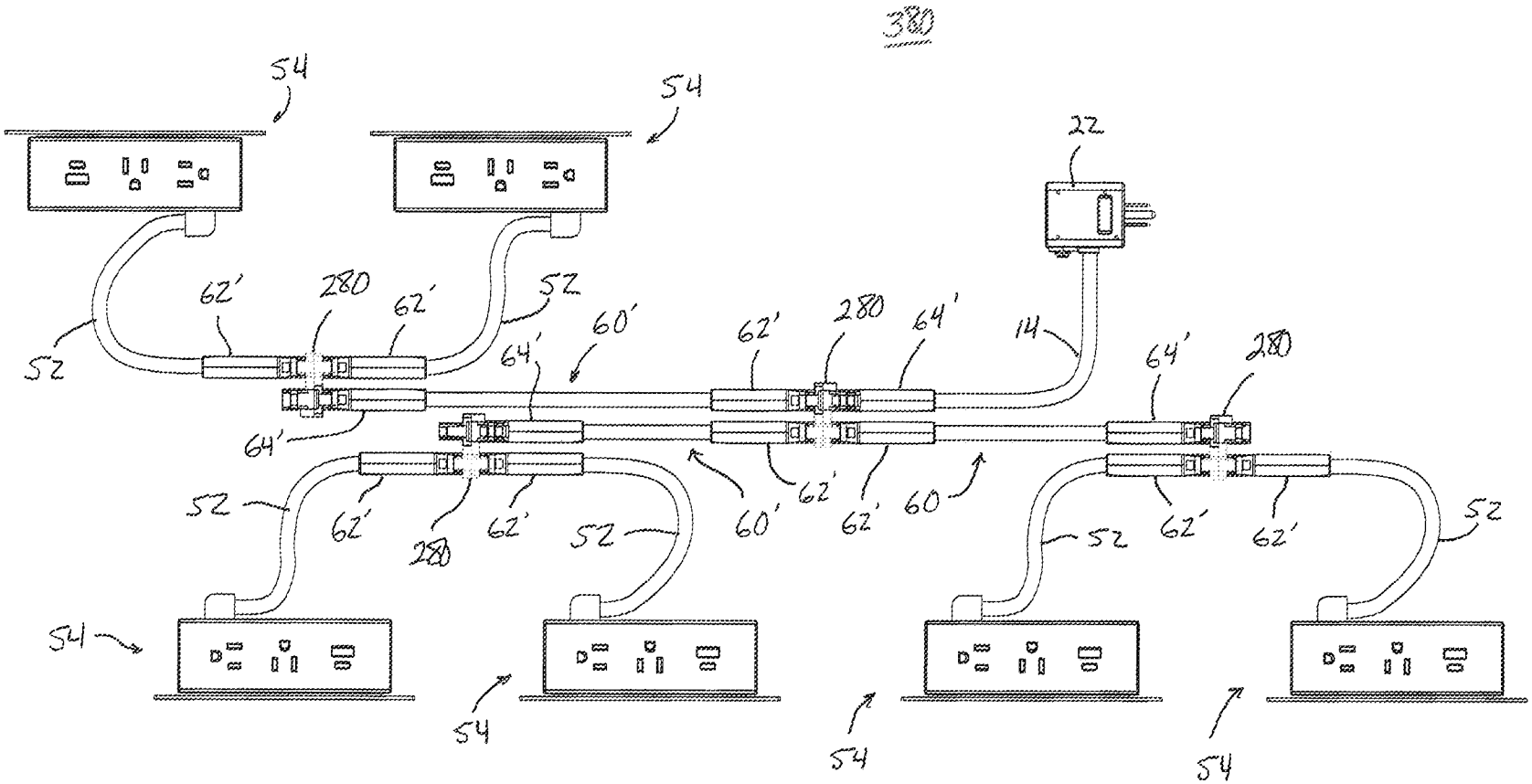
FIGS. 26A-26C are elevation views of different combinations of four-way junctions, jumper wire assemblies, and power outlet branches forming electrical distribution systems similar to those of FIG. 19.
Figure 26B:
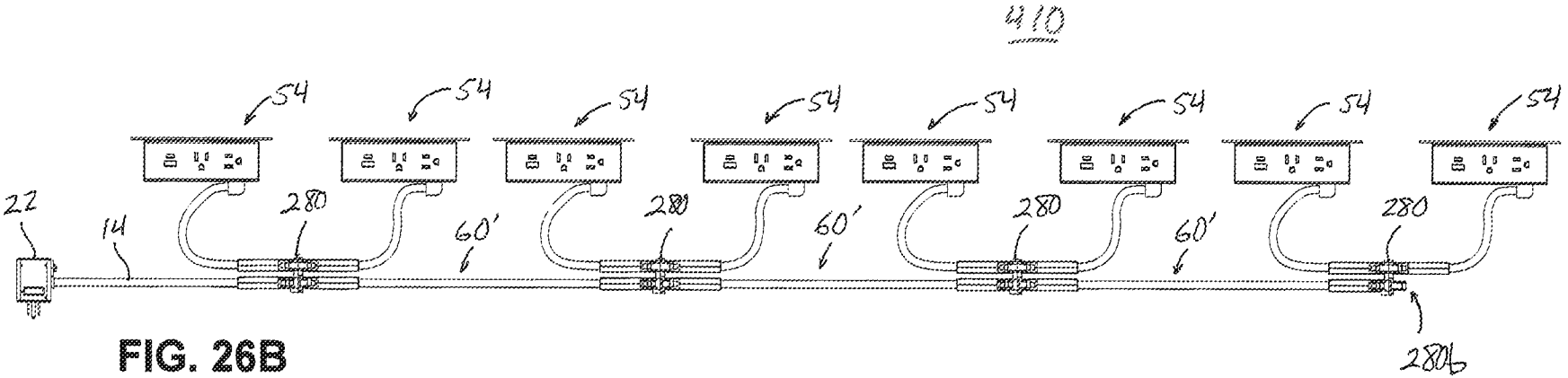
Figure 26C:
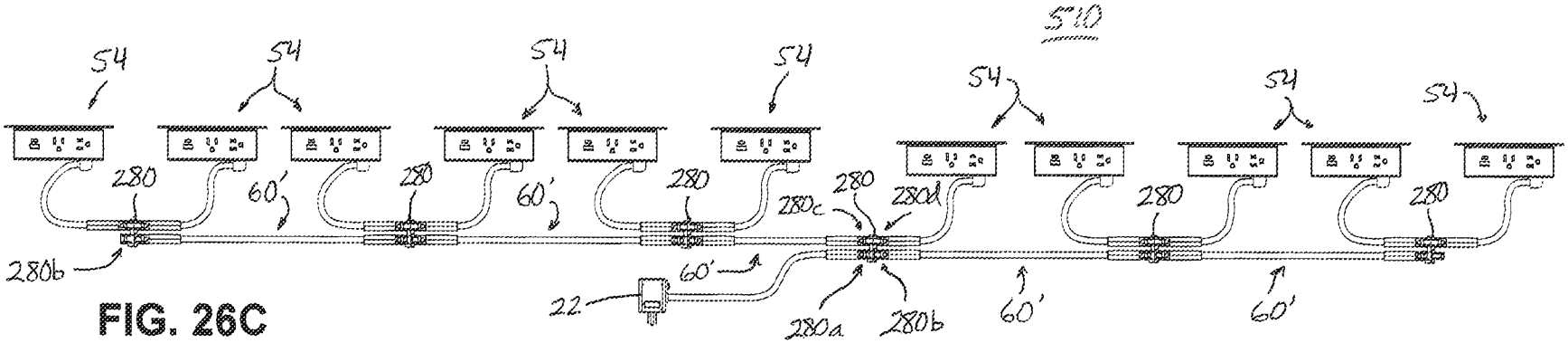

Additional combinations of power and/or data units 54, H-shaped electrical connectors 280, and power in/out jumper cables 60' may be assembled together to achieve different numbers of power or data units 54 in different areas. For example, FIG. 26A illustrates another electrical distribution system 310 having a single electrical power infeed 14 supplying power to six power units 54 via four H-shaped electrical connectors 280 and three power in/out jumper cables 60'. In FIG. 26B there is shown another electrical distribution system 410 in which pairs of power units 54 are coupled to each H-shaped electrical connector 280, which is coupled to a downstream connector 280 by a power in/out jumper cable 60' in series until a fourth connector 280 has its first power output receptacle 280*b* left open. Electrical capacity may be increased by branching groups of power units 54 off of the first H-shaped electrical connector 280, such as shown in FIG. 26C in which another electrical distribution system 510 includes four power units 54 receiving power from the first power output receptacle 280*b*, six power units 54 receiving power from the second power output receptacle 280*c*, and one power unit 54 receiving power from the third power output receptacle 280*d*. Optionally, additional power units may be disposed along a given flexible branch extension 52, such as in the manner shown in FIG. 12.

Figure 27A:
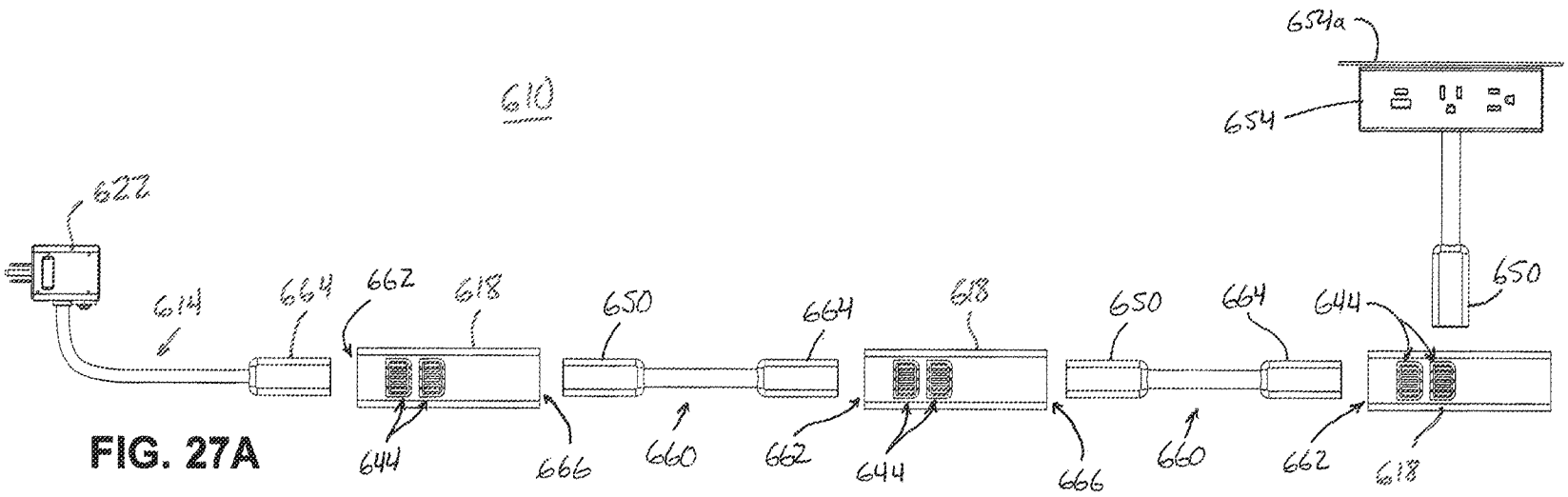
FIGS. 27A and 27B are elevation views of electrical distribution systems in accordance with the present invention.
Figure 27B:
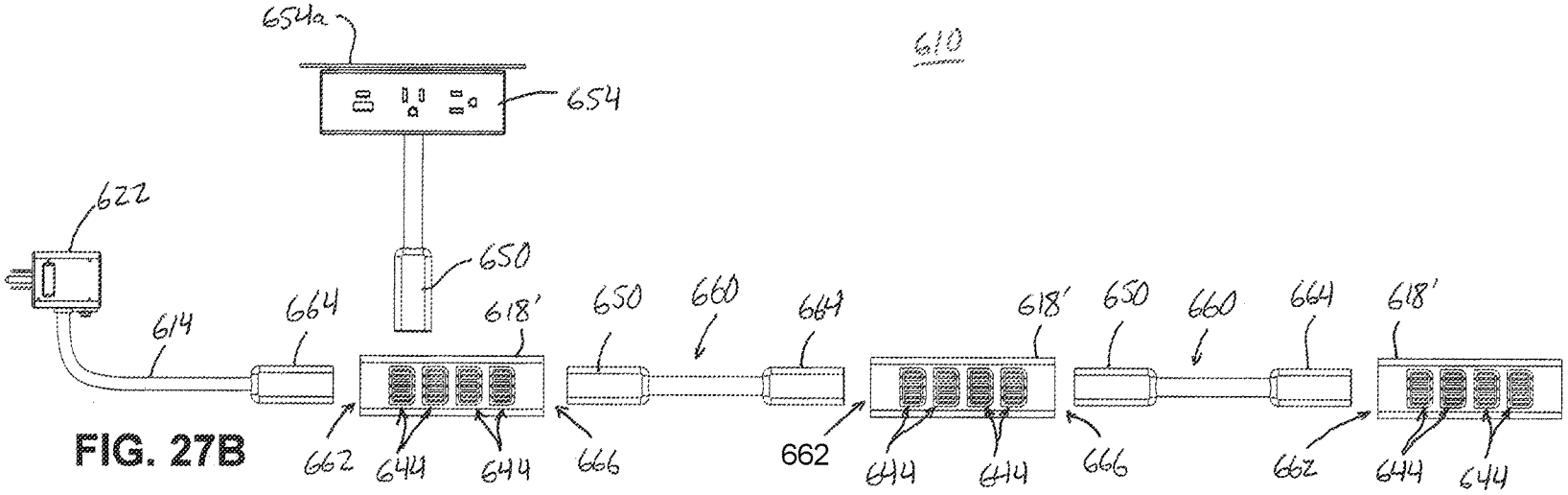
Figure 28A:
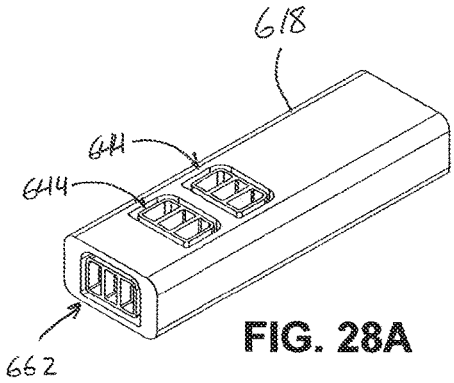
FIGS. 28A and 28B are perspective views of electrical junction blocks of the electrical distribution systems of FIGS. 27A and 27B.
Figure 29:
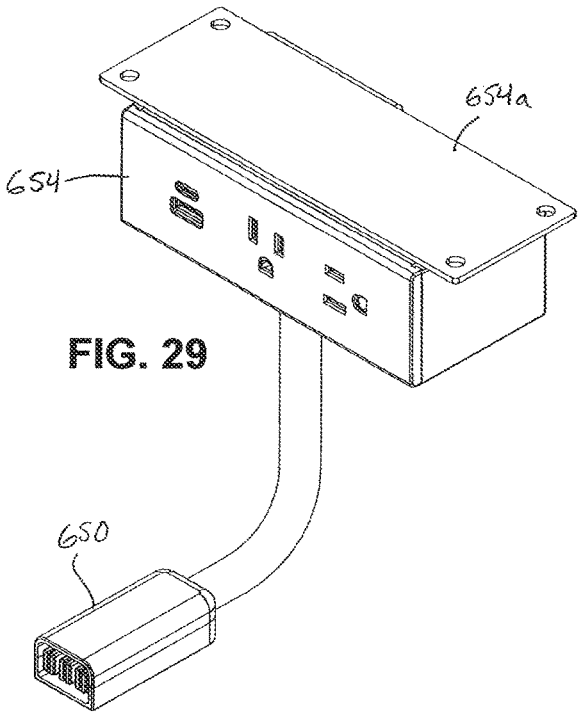
FIG. 29 is a perspective view of a power outlet branch of the electrical distribution systems of FIGS. 27A and 27B.
Figure 28B:
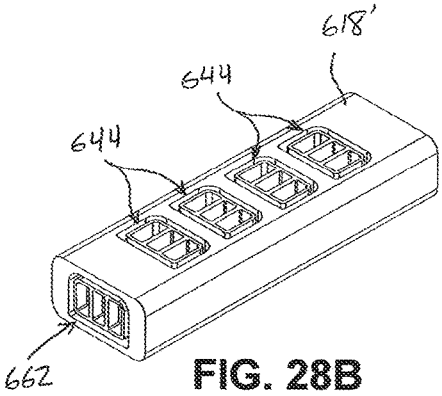
Figure 30:
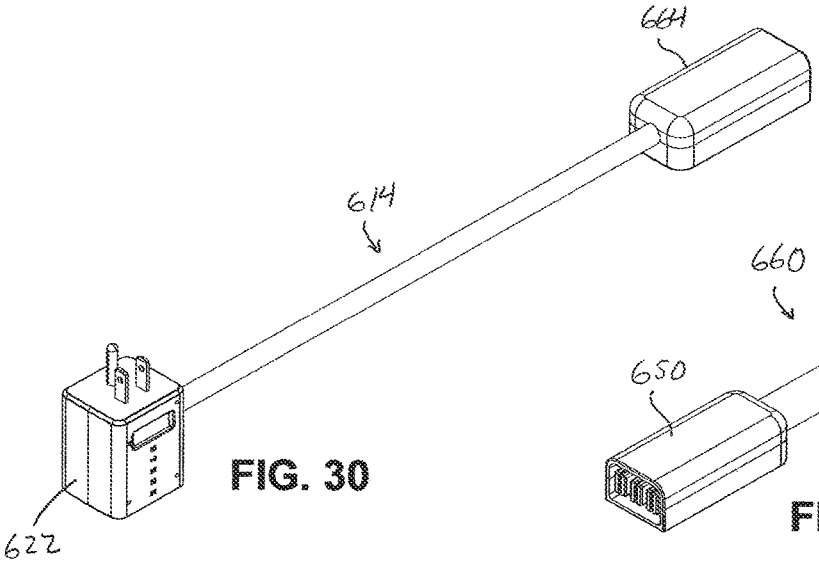
FIG. 30 is a perspective view of an electrical power infeed of the electrical distribution systems of FIGS. 27A and 27B.
Figure 31:
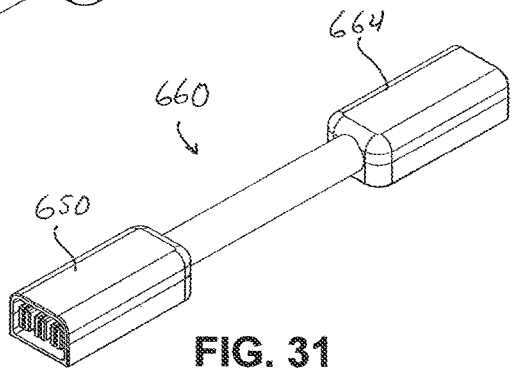
FIG. 31 is a perspective view of a jumper wire assembly of the electrical distribution systems of FIGS. 27A and 27B.

As discussed above, it will be appreciated that different types of connectors may be used to ensure that only compatible electrical components are used in a given electrical distribution system. For example, and with reference to FIGS. 27A-31, another electrical distribution system 610 utilizes an electrical power infeed 614 with a power plug 622 for receiving electrical power, and a D-shaped output connector 664 that is received by a D-shaped input connector 662 (FIGS. 28A and 28B) of a junction module 618. In the illustrated embodiment of FIGS. 27A and 28A, each junction module 618 has two branch connectors 644 for receiving respective D-shaped branch plugs 650 of a power and/or data unit 654 having an under-surface mounting bracket 654*a*, such as also shown in FIG. 29. The junction modules 618 further include a D-shaped output connector 666 that may be identical to the D-shaped output connector 664 of electrical power infeed 614, and thus compatible for receiving the D-shaped plug 650 of a power in/out jumper cable 660 having a D-shaped output connector 664 at its opposite end. Optionally, and as shown in FIGS. 27B and 28B, another junction module 618' includes four branch connectors 644 so that four power and/or data units 654 may be connected thereto. Optionally, a fifth power unit 654 could be connected to the junction module's output connector 666 if the connector 666 is the same as the branch connectors 644.

The electrical distribution systems may utilize conventional multi-strand wiring or cabling for high voltage AC and/or low voltage DC electrical power transmission, or for electronic data transmission. It is further envisioned that the electrical distribution systems of the present invention may be implemented with flat wire electrical conductors, such as those disclosed in commonly-owned U.S. patent application Ser. No. 16/191,517, now U.S. Pat. No. 11,081,815, issued Aug. 3, 2021, entitled "ELECTRICAL POWER OR DATA DISTRIBUTION SYSTEM", which is hereby incorporated herein by reference in its entirety.

Therefore, the present invention provides electrical distribution systems that may include modular electrical floor runner systems and/or work surface electrical systems incorporating wiring and electrical and/or electronic or data outlets, such as for use in office areas, industrial or work spaces, homes, or the like. The modular electrical floor runner is generally low-profile and unobtrusive, so that it may be unobtrusively placed along a floor or walking space, or along another support surface. The modular electrical floor runner can be configured to difference lengths and/or shape and/or routing, with limited regard for the order in which floor runner modules and junction modules are placed, or for the total number of floor runner modules and junction modules used. The work surface electrical distribution systems may provide similar functionality as the modular electrical floor runner systems, and may be compatible for use with the modular electrical floor runner systems so that power can be directed to desired areas and/or surfaces within a work area. The system may also be readily reconfigurable in order to accommodate changing needs or configurations within a work area.

The floor runner system allows users to provide power to the center of a room that doesn't already have power access, such as from a wall outlet to a group of tables or workstations. The system connects to power via a cord and either a conventional plug or a proprietary connector, the latter being appropriate especially for multi-circuit systems. The floor runner system can easily be relocated to other areas, and can easily be reconfigured to provide desired number of outlets in desired locations. The modular aspect facilitates the provision of a desired number of access points, substantially without concern for providing excess access points because the electrical capacity of the assembled system will typically be well in excess of the capacity of its circuit breaker. Thus, the system does not require counting, placing floor runner modules in a specific order (due to keying), or other methods of restricting the number of floor runner modules within the system. The modular electrical system can be mounted on top of floor surfaces, as opposed to under carpeting, and can optionally be secured to a floor surface with adhesives, threaded fasteners, or the like. The dimensions and shape configuration of the housings that form the outer portions of each rigid elongate housing allows the system to meet requirements of the Americans with Disabilities Act (ADA).

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A modular electrical system for routing electrical power and/or data from one area to another within a work area, said modular electrical system comprising:

an electrical power infeed including an electrical input plug and a first electrical output connector;

an electrical distribution assembly comprising:

a first electrical input connector for receiving said first electrical output connector;

an electrical output assembly comprising at least one branch output connector and a first jumper output connector; and a plurality of electrical conductors disposed between said first electrical input connector and said electrical output assembly;

a power or data unit comprising:

a branch plug connector for engaging said branch output connector;

an electrical power or data receptacle for supplying power or data to an electrical or electronic device; and a flexible branch extension wire extending between said branch plug connector and said electrical power or data receptacle; and a power jumper cable comprising a jumper input connector for connection to said first jumper output connector, and a second jumper output connector.

2. The modular electrical system of claim 1, wherein said electrical output assembly comprises two or more of said branch output connectors.

3. The modular electrical system of claim 2, wherein said first jumper output connector is identical to said branch output connectors.

4. The modular electrical system of claim 1, further comprising a rigid elongate housing defining an elongate channel for receiving said plurality of electrical conductors disposed between said first electrical input connector and said electrical output assembly, wherein said rigid elongate housing is configured for placement along a floor surface.

5. The modular electrical system of claim 1, wherein said power jumper cable comprises another one of said branch plug connectors.

6. The modular electrical system of claim 1, wherein said electrical power or data receptacle comprises at least one chosen from a high voltage AC receptacle, a low voltage DC receptacle, a wireless electrical power output, and an electronic data receptacle.

7. A modular electrical system for routing electrical power and/or data from one area to another within a work area, said modular electrical system comprising:

an electrical power infeed including an electrical input plug and a first electrical output connector;

an electrical distribution assembly comprising:

a first electrical input connector for receiving said first electrical output connector;

an electrical output assembly; and a plurality of electrical conductors disposed between said first electrical input connector and said electrical output assembly;

an electrical splitter connector configured for connection to said electrical output assembly, wherein said electrical output assembly comprises an input connector and at least three output connectors, said at least three output connectors including first and second branch output connectors and a first jumper output connector;

a power or data unit comprising:

a branch plug connector for engaging said first branch output connector;

an electrical power or data receptacle for supplying power or data to an electrical or electronic device; and a flexible branch extension wire extending between said branch plug connector and said electrical power or data receptacle; and a first power jumper cable comprising a jumper input connector for connection to said first jumper output connector, and a second jumper output connector.

8. The modular electrical system of claim 7, wherein said at least three output connectors are identical to one another, and said jumper input connector is identical to said branch plug connector.

9. The modular electrical system of claim 8, further comprising:

a second power jumper cable electrically coupled to said second branch output connector;

a second electrical splitter connector coupled to said second power jumper cables; and another power or data unit coupled to said second electrical splitter.

10. The modular electrical system of claim 7, wherein said electrical power or data receptacle comprises at least one chosen from a high voltage AC receptacle, a low voltage DC receptacle, a wireless electrical power output, and an electronic data receptacle.

11. A modular electrical floor runner for routing electrical power and/or data from one area to another within a work area, said modular electrical floor runner comprising:

first and second floor runner modules each having a rigid elongate housing defining an elongate channel with a plurality of electrical conductors disposed in said elongate channel;

said first floor runner module having an upstream end portion configured to be electrically coupled to a power or data source and a downstream end portion including a downstream electrical runner connector in communication with said plurality of electrical conductors of said first floor runner module;

said second floor runner module having an upstream end portion with an upstream electrical runner connector and a downstream end portion with a downstream electrical runner connector, said upstream and downstream runner connectors of said second floor runner in communication with said plurality of electrical conductors of said second floor runner;

a first junction module comprising:

an upstream junction connector configured to engage said downstream electrical runner connector of said first floor runner module;

a downstream junction connector configured to engage said upstream runner connector of said second floor runner module; and a first branch receptacle in electrical communication with both said upstream and downstream junction connectors of said first junction module;

a first power or data unit having a mounting bracket for coupling to a table surface, wherein said first power or data unit is in electrical communication with said first branch receptacle;

a second junction module comprising:

an upstream junction connector configured to engage said downstream electrical runner connector of said first floor runner module;

a downstream junction connector configured to engage an upstream runner connector of a third floor runner module; and a second branch receptacle in electrical communication with both said upstream and downstream junction connectors of said second junction module; and a second power or data unit having a mounting bracket for coupling to a table surface, wherein said second power or data unit is in electrical communication with said second branch receptacle.

12. The modular electrical floor runner of claim 11, wherein said upstream end portion of said first floor runner module comprises an electrical cord and a plug for engaging and receiving power from an AC electrical outlet in the work area.

13. The modular electrical floor runner of claim 12, wherein said plug comprises a circuit breaker configured to selectively disconnect electrical continuity between at least one prong of said plug and a corresponding at least one of said electrical conductors in said first floor runner module.

14. The modular electrical floor runner of claim 13, wherein said first and second floor runner modules and said first and second junction modules have a first rated electrical capacity when assembled together, and wherein said circuit breaker has a second rated electrical capacity that is less than or equal to the first rated electrical capacity.

15. The modular electrical floor runner of claim 11, further comprising a third floor runner module having a rigid elongate housing defining an elongate channel with a plurality of electrical conductors disposed in said elongate channel, said third floor runner having an upstream end portion with an upstream electrical runner connector configured for connection to said downstream junction connector of said second junction module, and a downstream end portion with a downstream electrical runner connector, said upstream and downstream runner connectors of said third floor runner in communication with said plurality of electrical conductors of said third floor runner.

16. The modular electrical floor runner of claim 15, wherein said third floor runner is interchangeable with said second floor runner, and said first and second junction modules are interchangeable with one another.

17. The modular electrical floor runner of claim 16, further comprising at least two additional floor runner modules and at least two additional junction modules, wherein each of said at least two additional floor runner modules is interchangeable with each of said second and third floor runner modules, and each of said at least two additional junction modules is interchangeable with each of said first and second junction modules.

18. The modular electrical floor runner of claim 11, wherein said branch receptacles are positioned in respective upper surfaces of said first and second junction modules and face upwardly.

19. The modular electrical floor runner claim 11, further comprising:

first and second flexible branch extensions each having a branch plug configured for selective engagement with both of said branch receptacles of said first and second junction modules;

at least one conventional power or data outlet at each of said power or data units, opposite said branch plugs; and a respective plurality of branch conductors extending between each of said branch plugs and said conventional power or data outlet at each of said power or data units.

20. The modular electrical floor runner of claim 11, wherein said pluralities of electrical conductors in said first and second floor runner modules comprise a ground conductor, a neutral conductor, and at least two different line conductors on respective circuits.

* * * * *